US010932626B2

(12) United States Patent
Olsen et al.

(10) Patent No.: US 10,932,626 B2
(45) Date of Patent: Mar. 2, 2021

(54) SQUEEZABLE FLUID DISPENSER

(71) Applicant: PresentCare Inc., Marlborough, MA (US)

(72) Inventors: Thomas R. Olsen, Natick, MA (US); Bret Siarkowski, Marlborough, MA (US)

(73) Assignee: PresentCare Inc., Marlborough, MA (US)

( * ) Notice: Subject to any disclaimer, the term of this patent is extended or adjusted under 35 U.S.C. 154(b) by 0 days.

(21) Appl. No.: 16/219,116

(22) Filed: Dec. 13, 2018

(65) Prior Publication Data

US 2019/0183294 A1 Jun. 20, 2019

Related U.S. Application Data

(60) Provisional application No. 62/599,627, filed on Dec. 15, 2017, provisional application No. 62/639,452, filed on Mar. 6, 2018.

(51) Int. Cl.
*A47K 5/12* (2006.01)

(52) U.S. Cl.
CPC ..... *A47K 5/12* (2013.01)

(58) Field of Classification Search
CPC ..... A47K 5/12; A47K 5/1208; A47K 5/122; A47K 5/1211
USPC ..... 222/207, 181.3
See application file for complete search history.

(56) References Cited

U.S. PATENT DOCUMENTS 148,069 A * 3/1874 Kennish ..... B05B 11/3032 222/207
151,066 A * 5/1874 Warner ..... B05B 11/3032 222/207
537,111 A * 4/1895 Henderson ..... B05B 11/3032 222/207
605,161 A * 6/1898 Clement ..... A61J 9/00 215/11.1
774,848 A * 11/1904 Lindsay ..... A61J 9/00 215/11.1
996,330 A * 6/1911 Haines ..... B05B 11/3032 222/207
2,093,942 A * 9/1937 Stuff ..... A47K 5/1207 222/181.2
2,219,604 A * 10/1940 Trotter ..... B65D 35/40 222/207
2,689,066 A * 9/1954 Budnik ..... B65D 35/28 222/103
2,736,468 A * 2/1956 Hills ..... A47K 5/122 222/180
2,772,817 A * 12/1956 Jauch ..... A47K 5/1209 222/207

(Continued)

FOREIGN PATENT DOCUMENTS

EP 1047327 B1 5/2003
KR 2020130006407 U 11/2013

*Primary Examiner* — Benjamin R Shaw
(74) *Attorney, Agent, or Firm* — Loginov & Associates, PLLC; William A. Loginov

(57) ABSTRACT

A fluid dispenser can have a bottle holder and a dispenser bulb, and a bottle can be placed in the bottle holder so that fluids can drain down into the dispenser bulb. The dispenser bulb can have a dispenser pore that can be a slit. A user can squeeze the dispenser bulb, so that the fluid within the dispenser bulb can be dispensed through the dispenser opening.

17 Claims, 33 Drawing Sheets

(56) References Cited

U.S. PATENT DOCUMENTS 3,029,001 A * 4/1962 Blish ..... B05B 11/04 222/207
3,220,611 A * 11/1965 Zander ..... A47K 5/1208 222/95
3,300,099 A * 1/1967 Marona ..... G01F 11/08 222/207
4,085,867 A * 4/1978 Heller ..... A47K 5/122 222/181.3
4,330,071 A * 5/1982 Ohlson ..... A47K 5/1208 222/207
4,646,945 A * 3/1987 Steiner ..... A47K 5/1209 222/207
4,776,495 A * 10/1988 Vignot ..... A47K 5/1209 222/206
4,793,517 A * 12/1988 Washut ..... A47K 5/1211 222/129
4,880,161 A * 11/1989 Wright ..... B05B 11/3052 239/330
5,005,737 A * 4/1991 Rohr ..... B65D 1/32 137/845
5,067,680 A * 11/1991 Miller ..... A47K 3/281 222/181.2
5,348,188 A * 9/1994 Bohler ..... G01F 13/001 222/1
5,697,525 A * 12/1997 O'Reilly ..... A47K 5/1209 222/105
5,810,203 A * 9/1998 Brennan ..... G01F 11/08 222/207
6,341,718 B1 * 1/2002 Schilthuizen ..... B05B 11/04 222/207
6,343,712 B1 * 2/2002 Flackett ..... B65D 23/003 222/183
D612,263 S 3/2010 Miksovsky
D612,264 S 3/2010 Miksovsky
D612,741 S 3/2010 Miksovsky
7,959,036 B2 6/2011 Koh
8,172,115 B1 * 5/2012 Mulhauser ..... B05B 11/061 222/633
8,783,520 B2 * 7/2014 Hagleitner ..... A47K 5/1207 222/207
2007/0114246 A1 * 5/2007 Awbrey ..... B65D 23/003 222/181.2
2007/0157991 A1 * 7/2007 Robertson ..... A47K 5/1208 141/360
2007/0187430 A1 * 8/2007 Chen ..... B65D 47/0804 222/105
2008/0156829 A1 * 7/2008 Chen ..... A47K 5/1208 222/207
2009/0196677 A1 * 8/2009 Wright ..... B65D 47/2031 401/264
2011/0290825 A1 * 12/2011 Gordon ..... A47K 5/122 222/181.2
2012/0193376 A1 * 8/2012 Evans ..... B05B 11/048 222/207
2012/0199609 A1 * 8/2012 Schwenkenberg ..... A47K 5/122 222/181.3
2013/0092708 A1 * 4/2013 Geiberger ..... A47K 5/1209 222/153.03
2014/0034677 A1 * 2/2014 Pagliarulo ..... B05B 11/0059 222/158
2014/0367422 A1 * 12/2014 Drennow ..... B67D 7/36 222/207
2015/0048119 A1 * 2/2015 Boehm ..... B01L 3/502738 222/207
2015/0306622 A1 * 10/2015 Ashworth ..... F16M 13/022 248/205.8
2017/0232121 A1 * 8/2017 Chiu ..... B08B 3/044 422/28
2019/0091708 A1 * 3/2019 O'Brien ..... B05B 15/62

* cited by examiner

SQUEEZABLE FLUID DISPENSER

RELATED APPLICATIONS

This application claims the benefit of U.S. Provisional Application Ser. No. 62/599,627, entitled FLUID DISPENSER, filed Dec. 15, 2017, and U.S. Provisional Application Ser. No. 62/639,452, entitled FLUID DISPENSER, filed Mar. 6, 2018, the teachings of each of which applications are expressly incorporated herein by reference.

FIELD OF THE INVENTION

This invention relates to liquid dispensers, and more particularly to dispensers for shower products.

BACKGROUND OF THE INVENTION

This application relates broadly to dispensers for fluids. Fluid dispensers have been used for the dispensing of liquid soaps and other hygiene products for many years. Many of these dispensers require a user to purchase fluid products in packaging that is specially designed for use in a particular dispenser. As an example, many hand-soap dispensers in use in public bathrooms dispense soap that has been packaged in plastic bags that often have built in nozzle features, and are often custom designed to fit within a particular dispenser. This type of dispenser often requires a user to purchase soap that comes in a container that has been designed to be compatible with a particular dispenser, and significantly reduces the choice of soaps or other liquid products available to a user. Other fluid dispensers can require a user to carefully pour a fluid into the top of the dispenser so that it can be dispensed from the bottom. This can be messy and inconvenient.

Fluid dispensers for liquid soaps or other hygiene products often have various moving parts that can be prone to breaking or otherwise wearing out. Hand-soap dispensers often have a lever or other mechanical device that a user can physically push or pull, which in turn causes fluids to be dispensed through mechanical mechanisms. Other hand-soap dispensers can have mechanical pumps or other machinery that requires a power source and can break down through repeated usage. Still other dispensers, such as hygiene product dispensers in public showers, can also have push buttons or other mechanical mechanisms that can break down through repeated usage.

Given the inconveniences of various fluid dispensers currently available, many consumers chose to use shampoos and other liquid soaps in original bottles, which are often stored in an upright position on a flat bottom, and turned upside down to dispense so that the fluid can flow to an opening in the cap. Particularly in homes with more than one user, the limited number of flat surfaces in an average shower can result in insufficient space for storing everyone's various bottles in the upright position in the shower. A user who has shampooed his or her hair but has not yet rinsed the shampoo out may also keep his or her eyes closed while fumbling amongst the various bottles strewn about the shower for a second bottle, such as a body wash. This blind groping can be inconvenient and possibly dangerous.

This method of bottle storage can also be inconvenient for viscous fluids, and for bottles that are nearing empty, since a user must invert the bottle, and then wait patiently for the fluid to flow down to the opening in the cap before the fluid can be dispensed. Many users will waste the last bit of fluid in a bottle rather than wait patiently for the fluid to flow down to the opening in the cap.

SUMMARY OF THE INVENTION

The fluid dispenser of the present disclosure overcomes disadvantages of the prior art by providing a device and method for conveniently dispensing fluids from the original packaging. A fluid dispenser can allow a user to store a bottle in an inverted position and dispense fluids from the bottle without the need for mechanical levers, buttons, motors, or other mechanical components that are prone to breakage.

In an embodiment, a fluid dispenser can have a dispenser bulb with an inner reservoir, an opening at the top of the bulb for fluid to drain into the bulb, and a dispenser pore. The dispenser pore can remain closed in a relaxed conformation, and the dispenser pore can be adapted to open and release a fluid stored in the inner reservoir when the bulb is squeezed by a user. The dispenser bulb can be made of silicone. The dispenser pore can be a slit in the dispenser bulb. A width of the dispenser bulb can be greater than a depth of the dispenser bulb. The fluid dispenser can have a bottle holder, and the bottle holder can be configured to hold a bottle with the mouth of the bottle facing downwards into the dispenser bulb, and the bottle can be removably sealed to the fluid dispenser so that the fluid can only be released through the dispenser pore.

In an embodiment, a fluid dispenser can have a dispenser bulb with an inner reservoir, an opening at the top of the bulb for fluid to drain into the bulb, and a dispenser pore. The dispenser pore can remain closed in a relaxed conformation, and the dispenser pore can be adapted to open and release a fluid stored in the inner reservoir when the bulb is squeezed by a user. The dispenser can have a bottle holder configured to hold a bottle with a mouth of the bottle facing downwards into the dispenser bulb. The dispenser bulb can be made of silicone. The dispenser pore can be a slit in the dispenser bulb. The fluid dispenser can be unitary and made of a silicone. The dispenser pore can be a slit cut in the dispenser bulb. The fluid dispenser can have at least one hook on an exterior surface of the bottle holder, the hook being unitary with the bottle holder. The bottle holder can have an air-release mechanism on an inner surface of the bottle holder, and the air release mechanism can be vertical ribs, horizontal ribs, or bumps. The bottle holder can have at least one air-release hole through a wall of the bottle holder. The fluid dispenser can have at least one suction cup mount adapted to engage with a suction cup. The suction cup mount can be thicker at the bottom and thinner at the top, so that a fluid dispenser is held farther away from a mounting surface at the bottom of the suction cup mount. The fluid dispenser can have a stand-off extension extending outwards from the bottle holder below the suction cup mount. A width of the dispenser bulb can be greater than a depth of the dispenser bulb. The bottle holder can be configured to be removably sealed to the bottle.

In an embodiment, a method of dispensing a fluid can include removing a cap from a bottle, holding a fluid dispenser over the bottle, sliding the fluid dispenser downwards over the bottle until the fluid dispenser is engaged with the bottle, turning the fluid dispenser and the bottle over so that a mouth of the bottle is facing downwards towards a dispenser bulb of the fluid dispenser, and a fluid within the bottle flows down into a reservoir in the dispenser bulb, and squeezing the dispenser bulb to open a dispenser opening in the dispenser bulb and dispense the fluid out of dispenser pore in the dispenser bulb. The method can include releasing the dispenser bulb so that the dispenser bulb pore closes and fluid within the bottle drains down into the reservoir of the dispenser bulb.

BRIEF DESCRIPTION OF THE DRAWINGS

The invention description below refers to the accompanying drawings, of which.

DETAILED DESCRIPTION

Figure 1A:
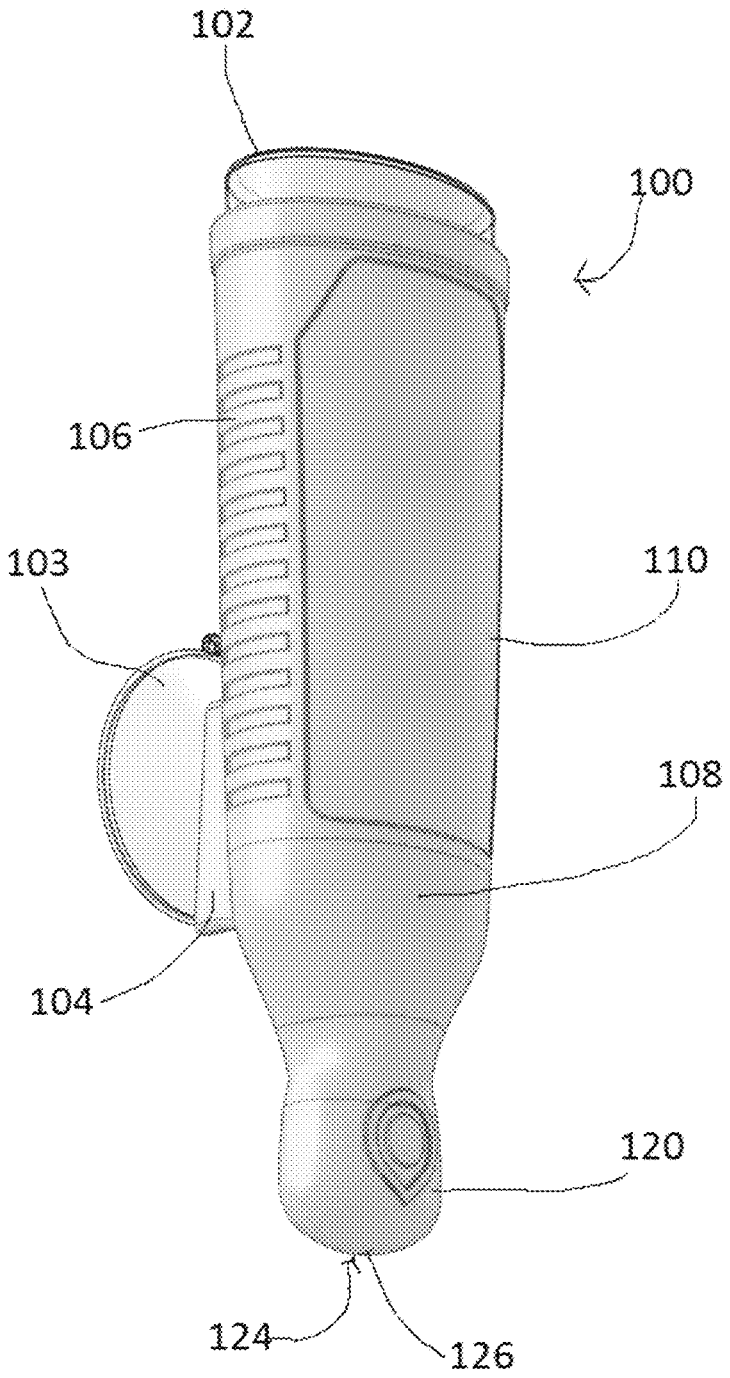
FIG. 1A is a perspective view of a fluid dispenser, according to an illustrative embodiment.
Figure 1B:
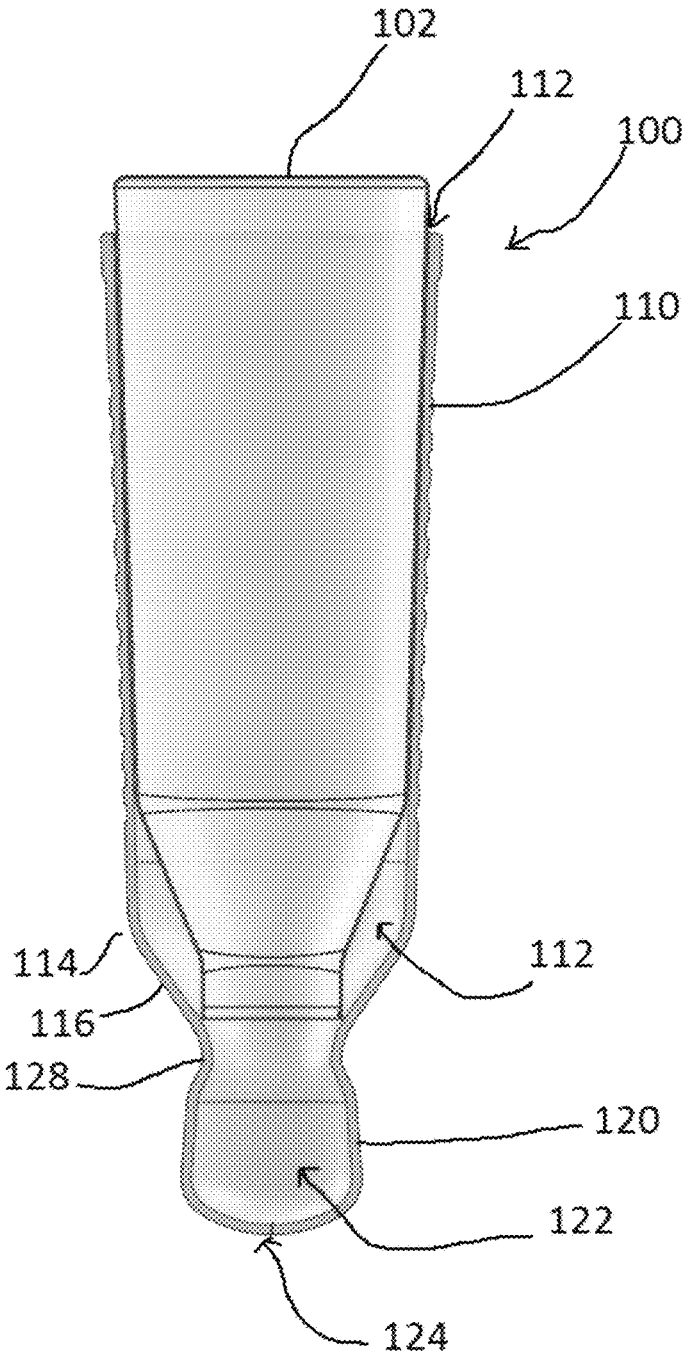
FIG. 1B is a cutaway view of a fluid dispenser with an inserted bottle, according to an illustrative embodiment.

FIG. 1A is a perspective view of a fluid dispenser, according to an illustrative embodiment. A fluid dispenser 100 can have a suction cup 103, a suction cup mount 104, and grips 106. A fluid dispenser can have a front side 108 that can be oriented towards a user. A fluid dispenser 100 can have a bottle holder 110 and a dispenser bulb 120. A fluid dispenser 100, including a bottle holder 110 and a dispenser bulb 120, can be molded or otherwise manufactured as a single, unitary component. The fluid dispenser 100 of the present disclosure can accommodate a bottle 102 placed within the bottle holder 110 of the fluid dispenser 100. FIG. 1B is a cutaway view of a fluid dispenser with an inserted bottle, according to an illustrative embodiment. A bottle holder 110 can define a bottle pocket 112 within the fluid dispenser 100. A bottle holder 110 can have a shoulder 114 and a tapered region 116 below the shoulder 114. A user can remove the cap from a bottle 102 and can insert the bottle 102 into the bottle pocket 112. The fluid dispenser 100 and bottle 102 can be oriented with the bottle opening facing downwards, so that fluid within the bottle can flow downwards under the force of gravity into the dispenser bulb 120. The shoulder of the bottle 102 can rest in the shoulder 114 of the fluid dispenser, and the shoulder 114 and/or the tapered region 116 below the shoulder can act as a stop on which the bottle 102 can rest. The shoulder 114 and/or the tapered region 116 below the shoulder 114 can prevent the neck of the bottle 102 from entering the dispensing bulb region. The taper from the shoulders to the bulb allows any liquid contents that may be in the shoulder region to flow down into the dispensing bulb 120. The dispenser bulb 120 can define a dispenser reservoir 122 that can hold fluid that has drained from the bottle 102. Fluid can drain from the bottle 102 until the dispenser reservoir 122 is full. The dispenser bulb 120 can have a neck 128, and the reservoir 122 can be wider than the neck 128. Turning to FIGS. 1A and 1B, the dispenser bulb can have a dispenser opening that can be a dispenser pore 124. Dispenser pore can be a slit 126 that passes through the dispenser bulb 120. When a user squeezes the dispenser bulb 120, fluid within the reservoir 122 can be dispensed through the open dispenser pore 124.

Figure 2A:
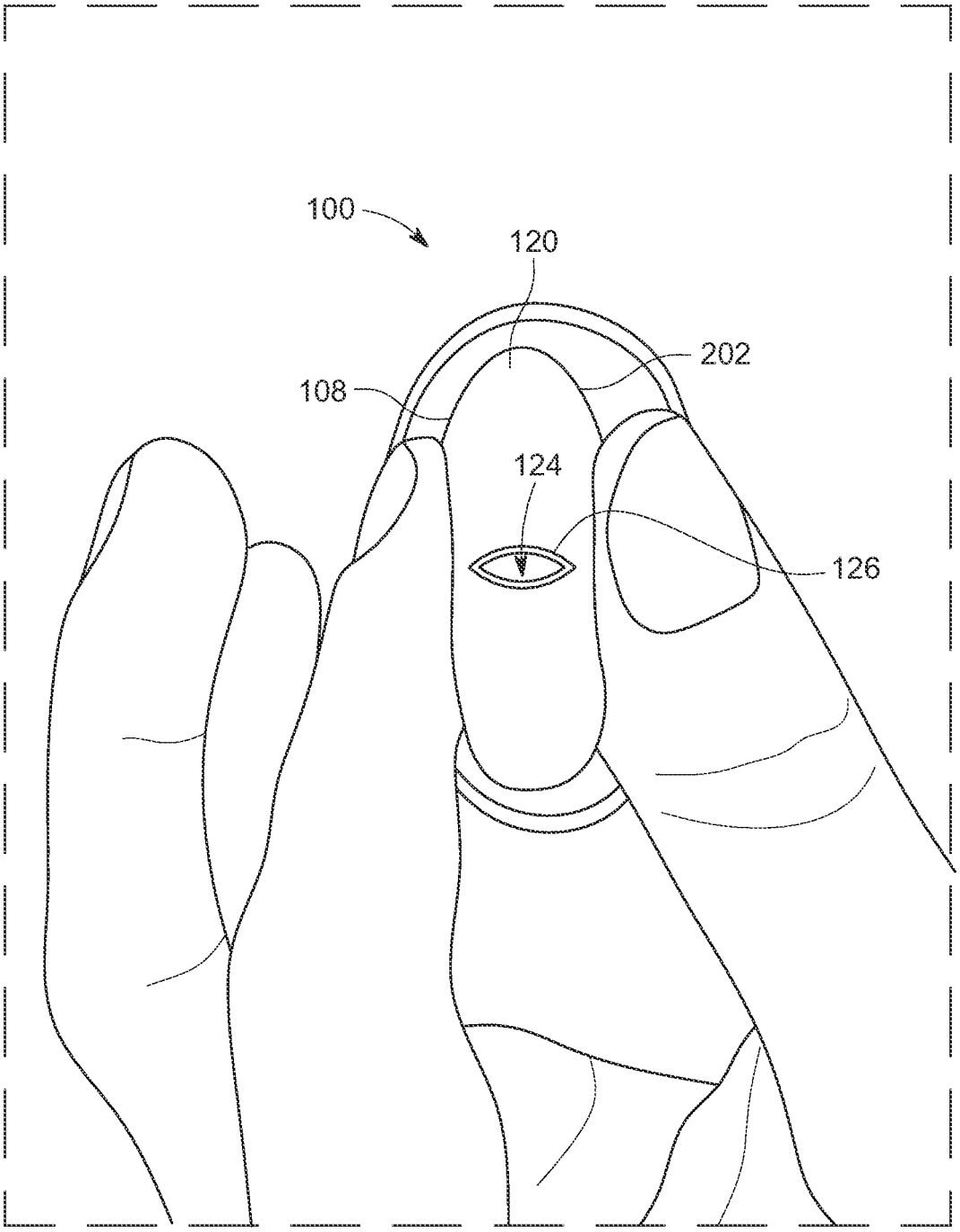
FIG. 2A is a bottom view of a fluid dispenser showing the dispenser pore in an open conformation, according to an illustrative embodiment.

FIG. 2A is a bottom view of a fluid dispenser showing the dispenser pore in an open conformation, according to an illustrative embodiment. The dispenser pore 124 can be a slit that can be oriented along a line between the front side 108 and the back side 202 of the fluid dispenser 100. A user can squeeze the dispenser pore 124 open by pressing the front of the bulb and the rear of the bulb towards each other. The user can press the front and back of the bulb 120 towards each other by squeezing them between the user's fingers or fingers and thumb. Squeezing the bulb 120 open does not require the front of the bulb and the rear of the bulb to be pressed into contact with each other. As shown in FIG. 2A, the dispenser pore 124 can be opened by a moving the front of the bulb and the rear of the bulb towards each other over a small distance. The distance that the front and/or the rear of the bulb must be moved towards each other to open the dispenser pore can be a small percentage of the relaxed distance between the front of the bulb and the back of the bulb when they are in a closed, relaxed conformation. However, a user can squeeze the front and back of the bulb together so that the front of the bulb and the back of the bulb can be in contact with each other.

There can be a correlation between how close a user squeezes the front of the bulb and the back of the bulb together and the amount of liquid that is dispensed in a given amount of time. When the bulb is squeezed, the size of the pore can increase, the fluid reservoir space can decrease, and the fluid within the reservoir can be forcibly ejected. The closer the front of the bulb and the back of the bulb are squeezed together, the more the dispenser pore can be opened, and the more the reservoir space can decrease. The rate that the fluid flows out from the dispenser pore can be correlated with how close the front of the bulb and the back of the bulb are squeezed together. A user who squeezes the front and the back of the bulb a small distance towards each other can dispense a small amount of the fluid in a given amount of time when compared to a user who squeezes the front and the back of the bulb towards each other a greater distance for the same amount of time. The rate of fluid flow from the dispenser can be correlated with the distance the front and back of the bulb are squeezed toward each other. The amount of fluid that flows from the dispenser can be correlated with the distance the front and back of the bulb are squeezed toward each other. A user can control the rate and/or amount of flow by controlling the distance the user squeezes the front of the bulb and the back of the bulb towards each other.

The dispenser bulb 120 can be narrower from front to back, and wider from side to side. The narrow front-to-back dimension of the dispenser bulb can allow the dispenser pore 124 to open easily when the front of the dispenser bulb and the back of the dispenser bulb are squeezed towards each other, as shown in FIG. 2A. A wider side-to-side dimension can allow the reservoir to have a sufficient capacity, while still allowing the front and back of the reservoir to be close enough together so that the dispenser pore can open easily when the front and back of the dispenser bulb are squeezed towards each other. A dispenser pore 124 that has a slit 126 can efficiently dispense the contents of the reservoir 122 when the bulb 120 is squeezed. A narrower front-to-back dimension can allow a user to fully empty the reservoir easily by squeezing the front and back together, while a wider side-to-side dimension can allow the reservoir to hold a sufficient amount of fluid.

Figure 2B:
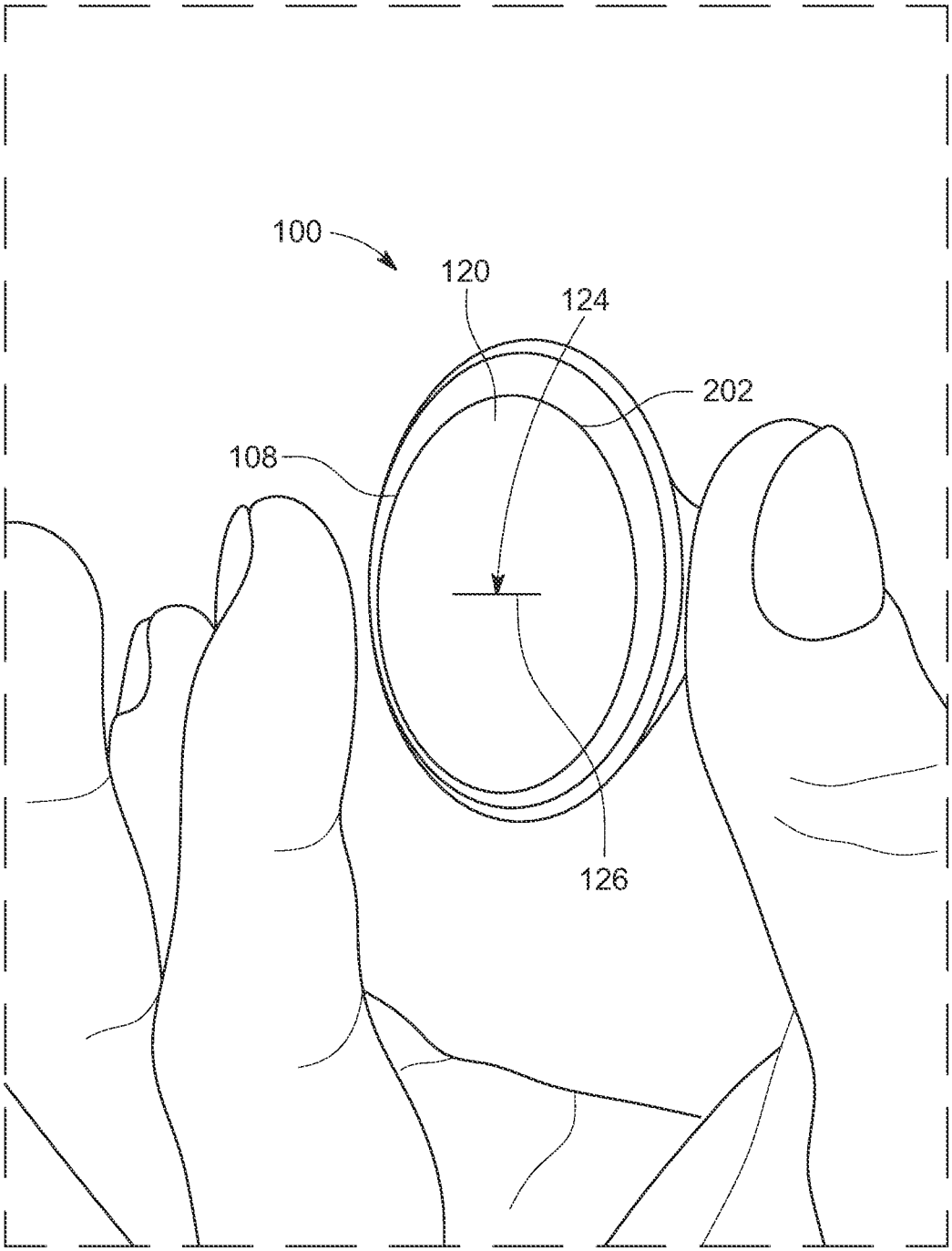
FIG. 2B is a bottom view of a fluid dispenser showing the dispenser pore in a relaxed, closed conformation, according to an illustrative embodiment.

FIG. 2B is a bottom view of a fluid dispenser showing the dispenser pore in a relaxed, closed conformation, according to an illustrative embodiment. When the dispenser bulb 120 is released, the dispenser pore 124 can return to the relaxed, closed conformation shown in FIG. 2B, so that fluids cannot drip out from the closed opening. In the relaxed, closed conformation, the pore 124 seals and prevents fluid from leaking through the pore 124, because the sides of the pore contact each other in the closed conformation. The dispensing bulb 120 automatically re-inflates and refills after every dispensing operation, regardless of the type or viscosity of the liquid inside. A dispenser pore that has a slit 126 in the silicone bulb can effectively prevent the fluid from leaking through the slit 126 when the bulb 120 is in a relaxed, closed conformation. By cutting a slit 126 into the bulb after the bulb has been manufactured, no material is removed from the bulb, and the sides of the slit can seal together in the relaxed conformation to prevent fluid from leaking through the dispenser pore 124.

In the illustrative examples shown in FIGS. 1 and 2, the dispenser pore is shown and described as a slit that is oriented along a line from the front to the back, and opening the dispenser pore is shown and described as squeezing the front of the bulb and the rear of the bulb towards each other. However, it should be made clear that in various embodiments, the dispenser opening can be alternate shapes, and/or can be oriented in different directions, such as side to side. In a side-to-side embodiment, the bulb may be longer in a front-to-back dimension and narrower in a side-to-side embodiment, and a user may squeeze the sides of the bulb towards each other. In another alternate embodiment, a bulb may be oriented at a convenient ergonomic angle, such as 45°, so that a user may easily grasp the bulb between the thumb and forefinger of the right hand. In various embodiments, a bulb can be axisymmetric, spheroid, or other shapes. In various embodiments, the bulb and dispenser opening can have a wide variety of shapes and orientations without departing from the present disclosure. In the interest of clarity and convenience, the present disclosure refers mainly to the embodiment having a bulb that is narrower in the front-to-back direction compared to a wider side-to-side direction, and a dispenser opening that is a slit oriented from front to back along the narrower direction. Although other embodiments are possible besides this particular arrangement, there can be advantages to having the dispenser pore be a slit oriented along a narrower direction, because the dispenser pore can be easier to open, and because the wider direction allows for a larger reservoir while still allowing the slit to open easily by squeezing a small distance along the narrower direction. A slit that is oriented along a line that connects the areas where a user will place a thumb and/or fingers to squeeze the bulb can be most effective, because the inward force exerted by a user on the bulb can be along the same line as the slit, and can result in the slit being opened easily. In another embodiment, a fluid dispenser may be free of a squeezable dispensing bulb. A fluid dispenser without a bulb can rely on compression of the bottle to dispense the contents of the bottle. A fluid dispenser without a bulb can have a dispensing pore 124 that can open to dispense fluid when the bottle is squeezed or compressed. A fluid dispenser without a bulb can have a dispensing pore that can have a slit 126. A fluid dispenser without a bulb can have a plastic dispensing pore that can have two slits forming an "X". The two "X" slits can form a seal that can prevent leakage and can allow product to dispense when the bottle is compressed.

Figure 3:
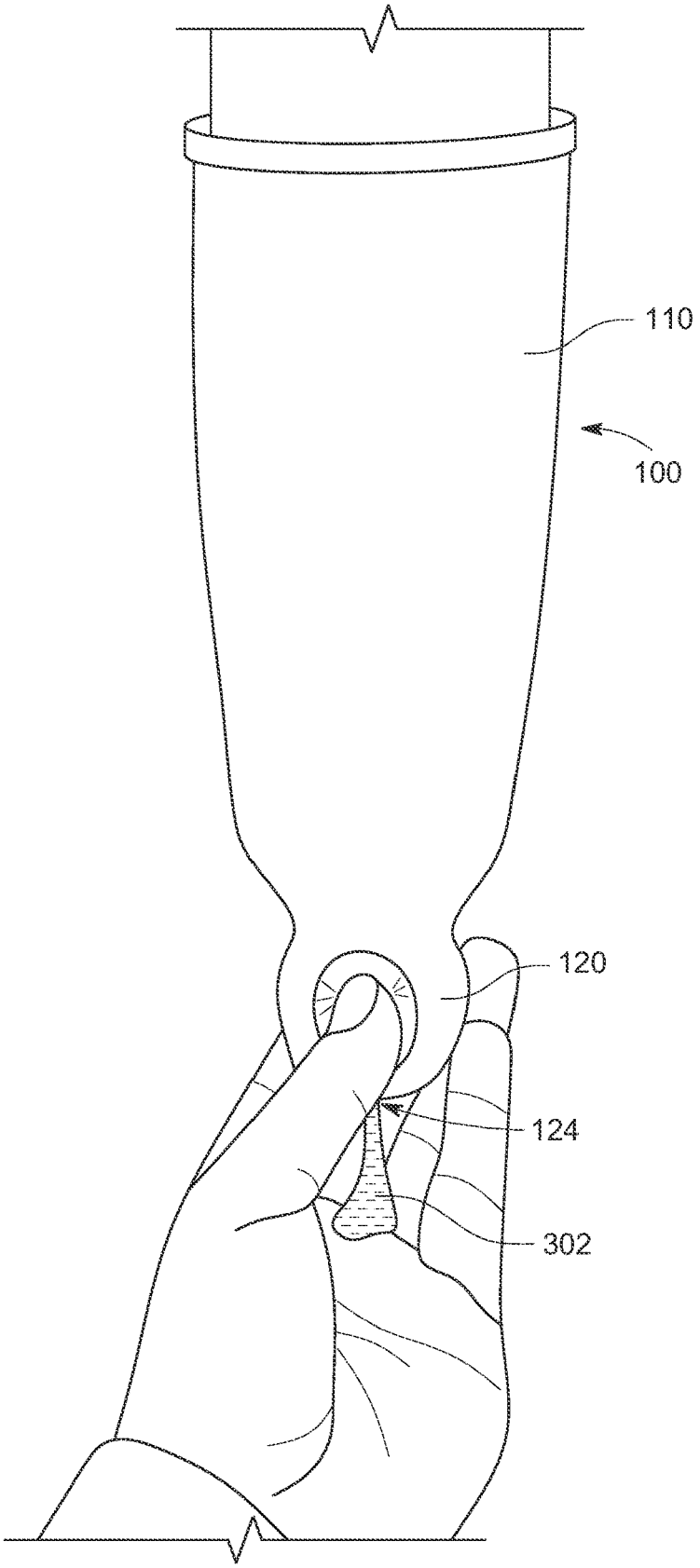
FIG. 3 is a perspective view of a fluid dispenser dispensing fluid, according to an illustrative embodiment.

FIG. 3 is a perspective view of a fluid dispenser dispensing fluid, according to an illustrative embodiment. A user can squeeze the dispenser bulb 120 to dispense a fluid 302, such as shampoo or other hygiene product. When the user applies inward pressure on the front and on the back of the dispenser bulb 120, thereby squeezing the front and the back of the dispenser bulb towards each other, the dispenser pore opens into an open conformation. When the user squeezes the front and back of the dispenser bulb towards each other, fluid within the reservoir can be squeezed out through the pore 124. The amount of fluid dispensed can be a predetermined quantity that can depend on the volume of the reservoir. A user can continue to hold the dispenser pore open by continuing to hold the front and the back of the dispenser bulb closer together than they would be in the relaxed, closed conformation. When a user continues to hold the dispenser pore open, fluid can drain downward from the bottle and through the dispenser pore 124. A user can hold the dispenser pore open until a desired amount of fluid has been dispensed. When the desired amount of fluid has been dispensed, the user can release the dispenser bulb, so that the bulb can return to the relaxed and closed conformation shown in FIG. 2B. When the user releases the dispenser bulb 120, the dispenser pore can close, the dispenser bulb can re-inflate to the relaxed shape, and the fluid can flow downwards from the bottle to refill the reservoir 122. After the reservoir has been refilled by the downward flow of fluid, the fluid dispenser 100 is ready to dispense another predetermined quantity of fluid from the reservoir. The fluid dispenser can dispense liquids of various viscosities ranging from very low viscosity fluids to high viscosity fluids such as thick pasty conditioners, and the fluid dispenser can prevent fluids of various viscosities from leaking out of the fluid dispenser when the dispenser is in the closed conformation.

The dispenser bulb can be made of a flexible material such as a silicone, urethane, rubber, or other materials that are flexible and stretchable. A dispenser bulb can be made of a silicone at least because silicone is safe for human contact, non-reactive with many shampoos, conditioners, body wash products, etc., and is durable, non-porous, able to stretch and deform elastically, is resistant to tearing, able to be color dyed, translucent, or opaque as desired, inexpensive, no/low odor, etc. A dispenser bulb 120 can be made of a transparent or translucent silicone that can have a platinum catalyst. The dispenser bulb 120 can be made of a silicone rubber with a durometer in a range of approximately Shore 30 A to Shore 50 A. The dispensing bulb 120 can be made of a silicone rubber with a durometer of approximately Shore 40 A. By way of non-limiting example, the dispenser bulb 120 can be made of a silicone rubber such as Smooth-On SORTA-Clear 40 Translucent Silicone Mold Rubber that has appropriate tear and tensile strength. In various embodiments, other materials with a Shore hardness outside of the between 30 A and 50 A may be acceptable, depending on the wall thickness of the bulb, the sleeve/bulb geometry, the desired function, the viscosity of the fluids to be dispensed, etc. The dispensing bulb can be made of a translucent material such as silicone rubber so that the fluid can be seen within the bulb, or the material of the dispensing bulb can be pigmented or otherwise colored. The bottle holder 110 can be made of the same or similar materials as the dispenser bulb 120. The bottle holder can be made of a translucent material so that a user can view the label or packaging of the bottle 102. The fluid dispenser 100 can be made of the same or similar materials as the dispenser bulb 120.

Figure 4A:
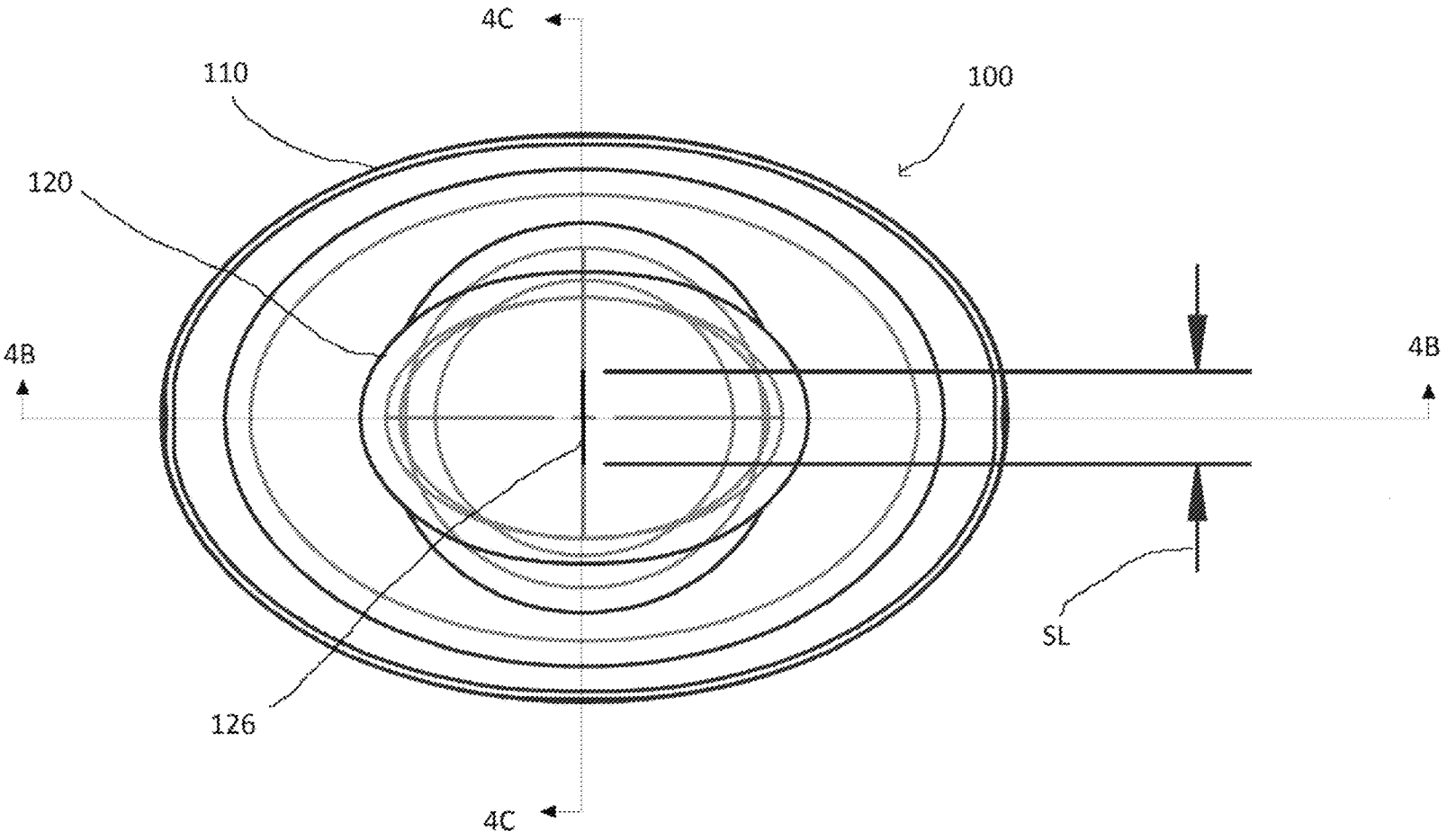
FIG. 4A is a bottom view of a fluid dispenser with exemplary dimensions, according to an illustrative embodiment.

FIG. 4A is a bottom view of a fluid dispenser with exemplary dimensions, according to an illustrative embodiment. A dispenser bulb 120 can have a opening that can be a slit 126. A slit 126 can have a slit length SL in a range from approximately 0.25 inches to approximately 0.50 inches. A slit 126 can have a slit length SL of approximately 0.375 inches. A slit length of 0.375 inches can effectively dispense fluids of various viscosities when the bulb is squeezed, and can prevent fluids from leaking through the slit when the slit is closed. Although various slit lengths are possible, a slit that is too short can create too much of an impediment to the outflow of the bulb's contents. This can cause the contents of the bulb to be pushed back upwards into the bottle instead of dispensing properly when a user squeezes the bulb. However, a slit that is too long can allow an excess of fluid to flow out when the opening 124 is opened. This can be especially true when the fluid has a low viscosity. A slit that is too long can also be prone to leakage. An optimal slit length allows an appropriate amount of fluid to be dispensed, regardless of viscosity.

Figure 4B:
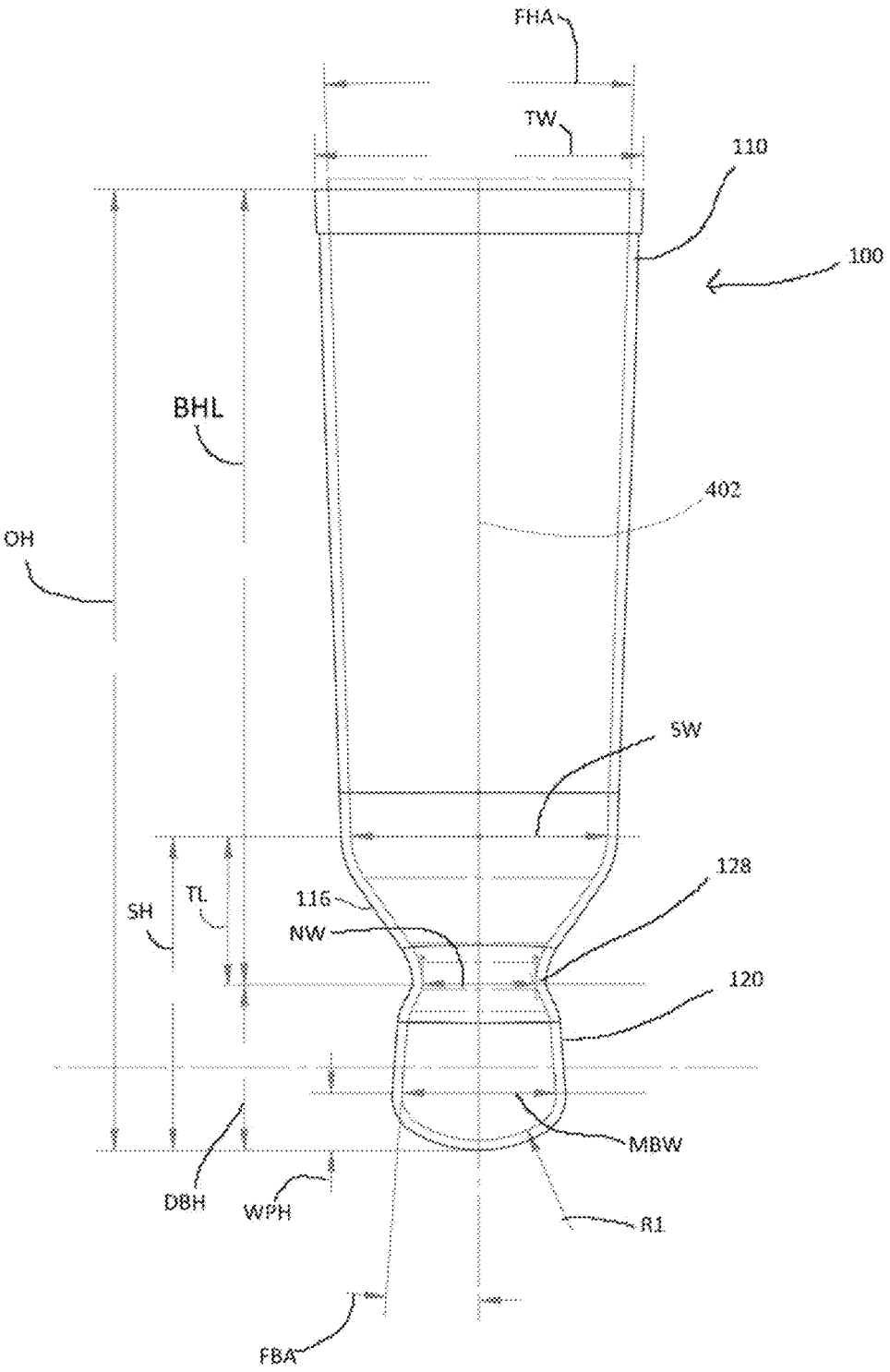
FIG. 4B is a front cross section of a fluid dispenser taken along line 4B-4B of FIG. 4A with exemplary dimensions, according to an illustrative embodiment.

FIG. 4B is a front cross section of a fluid dispenser taken along line 4B-4B of FIG. 4A with exemplary dimensions, according to an illustrative embodiment. A fluid dispenser 100 can have an overall height OH of approximately 8.8 inches. The top of the fluid dispenser can have a top width TW of approximately 3 inches. When viewed from the front, the sides of the bottle holder 110 can have a bottle holder angle FHA relative to each other of approximately 4°. The bottle holder 110 can have a bottle holder length BHL of approximately 7.3 inches. A bottle holder 110 can have a shoulder 114 with a shoulder height SH of 2.9 inches from the shoulder 114 to the bottom of the dispenser. The shoulder 114 can have a shoulder width SW of approximately 2.3 inches. A bottle holder can have a tapered region 116 that can have a tapered length TL between the shoulder 114 and the neck 128 that can be approximately 1.4 inches. The neck 128 can have a neck width NW of approximately 1 inch. A dispenser bulb 120 can have a dispenser bulb height DBH from the neck 128 to the bottom of the dispenser bulb of 1.5 inches. At the widest portion of the dispenser bulb 120, the dispenser bulb can have a maximum bulb width MBW of approximately 1.4 inches. The maximum bulb width MBW can be at a wide portion height WPH of approximately 0.5 inch. When viewed from the front, the sides of the dispenser bulb above the maximum bulb width can have a bulb angle FBA relative to a central axis 402 of approximately 4.5°. When viewed from the front, the lower portion of the dispenser bulb below the maximum bulb width can have a radius R1 of approximately 1.1 inches.

Figure 4C:
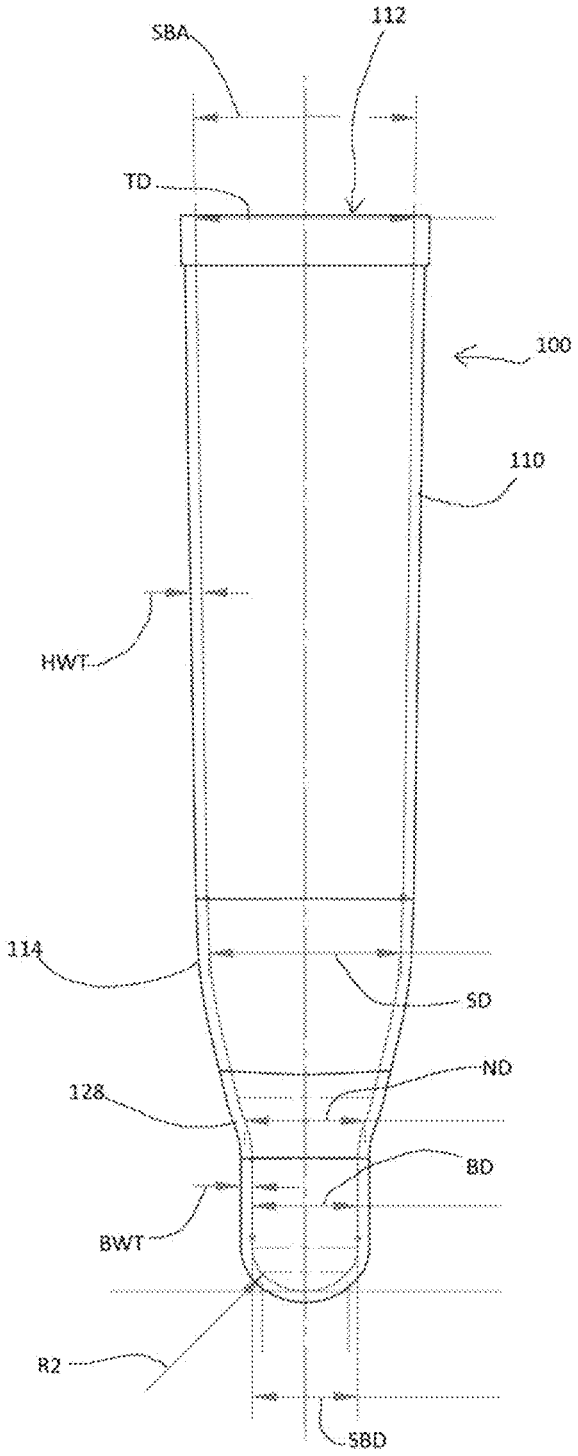
FIG. 4C is a side cross section of a fluid dispenser along line 4C-4C of FIG. 4A with exemplary dimensions, according to an illustrative embodiment.

FIG. 4C is a side cross section of a fluid dispenser along line 4C-4C of FIG. 4A with exemplary dimensions, according to an illustrative embodiment. The top of the fluid dispenser 100 can have a bottle pocket 112 with an inner depth at the top TD of approximately 1.8 inches. When viewed from the side, the sides of the bottle holder 110 can have a bottle holder angle SHA relative to each other of approximately 2°. The shoulder 114 can have a shoulder depth SD of approximately 1.5 inches. The neck 128 can have a neck depth ND of approximately 1 inch. The bulb 120 can have a first bulb depth BD of approximately 0.9 inches. The bulb 120 can have a second bulb depth SBD that can be the same as the first bulb depth BD, or can be more or less than the first bulb depth. When viewed from the side, at least a portion of the front side and the back side of the dispenser bulb can be parallel. In various embodiments, the front side and the back side of the dispenser bulb may not be parallel, and the second bulb depth can be greater or less than the first bulb depth. Various relationships between the first bulb depth and second bulb depth can promote fluid flow, provide increased ergonomics, or other potential benefits that can depend on the relationship between the first bulb depth and the second bulb depth. When viewed from the side, the lower portion of the dispenser bulb can have a radius R2 0.5 inches. It should be obvious that the above dimensions are provided as a non-limiting example, and are not intended to limit the scope of the present disclosure.

A bottle holder 110 can have a wall thickness HWT in a range between approximately 0.050 inches and approximately 0.150 inches. A bottle holder 110 can have a wall thickness HWT of approximately 0.090 inches. The thickness of the bottle holder wall can vary depending on various factors including material durometer, sleeve geometry, and desired function. The bottle holder wall thickness HWT can be thin enough to stretch and can conform to the various contours of the bottle, so that it can create a tight seal. The thicker bottle holder wall can create a particularly tight seal near the bottle opening. The bottle holder wall can form a seal with the bottle, so that fluid within the bottle can only be released through the dispenser opening. The bottle holder wall can prevent fluid from leaking out of the fluid dispenser, or being pushed back up into the bottle pocket outside of the bottle. The bottle holder wall thickness HWT can be thick enough to retain some structural rigidity and to prevent tearing of the bottle holder wall. A bottle holder can have regions of various wall thicknesses. A fluid dispenser can have regions with various wall thicknesses. A dispenser bulb 120 can have a wall thickness BWT in a range between approximately 0.05 inches and approximately 0.15 inches. A dispenser bulb 120 can have a wall thickness BWT of approximately 0.09 inches. The thickness of the dispenser bulb wall can vary depending on various factors including material durometer, bulb geometry, and desired function. The measurements presented here are intended as illustrative examples, however, other measurements are possible without departing from the present disclosure.

The bulb wall should be thick enough so that the two abutting edges of a slit can properly align and offer enough of a joining surface area to create a seal and hold back the contents of the bulb. The bulb wall should be thick enough so that the bulb will have enough structural rigidity re-inflate after being collapsed by the user when dispensing a fluid. The structural rigidity of the bulb in addition to the shape and size of the bulb can allow it to overcome any potential vacuum pressure that is created when the contents of the bottle are expelled. However, if the bulb wall is too thick, the dispenser opening 124 may not open sufficiently and may impede the outflow of the contents. The bulb can pull air back into the bulb through the slit as the user releases the bulb and the bulb is in transition from an open, dispensing state to the closed, sealed state. The air that flows back into the bulb can rise into the bottle, and fluid from within the bottle can flow down into the bulb. As the bulb returns to the relaxed shape, vacuum pressure caused by the bulb decompressing can pull fluid into the reservoir.

A bulb 120 should be large enough to hold a desired quantity of fluid to be dispensed. A bulb width that is relatively close to the width of an average person's fingers or thumb can make it easier for a user to vacate the contents of the bulb, because when a user squeezes a bulb that has this width, the contents of the bulb do not have another space within the bulb to flow to. Because there is nowhere inside the bulb for the fluid to flow when the bulb is squeezed, the path of least resistance is out the dispenser opening, and most of the contents of the reservoir can be emptied when the bulb is squeezed.

When the bulb is squeezed, the front and back faces of the bulb can be brought together internally so the front and back faces of the bulb are brought into contact with each other. This can create a partial pseudo-seal that can help prevent the contents from squeezing back up into the bottle. However, because this is not a tight seal, additional contents from the bottle can continue to flow down into the bulb and out the dispenser opening if the user keeps the bulb squeezed and the dispenser opening open. Various dimensions of the bulb relative to each other, including the depth, width, height, wall thickness, and curve radii of the bulb can have some impact on the bulb's ability to re-inflate after being squeezed.

The percentage that the slit is open when the bulb is squeezed can be proportional to the percentage the bulb is compressed and deflated due to the squeezing motion of the user. When the slit is open, some air may travel back into the bulb and prevent permanent deflation due to vacuum suction within the bulb. The bulb shape can contribute to the functions of the bulb, including the dispensing and re-inflating functions of the bulb. The large radius curves that can make up the left and right sides of the bulb can help give structural rigidity to the bulb, and can help the bulb re-expand due to the release of elastic potential energy stored in the material when they are deformed. The sidewalls of the bulb can be approximately vertical with the sidewalls of the bulb flaring slightly outward toward the bottom. This can help the contents of the bottle easily flow into the tip due to gravity. The flared-out design can help prevent the bulb contents from pushing back up into the bottle. The slight curvature of the bottom face of the bulb can help pull the two abutting edges of a slit apart when the bulb is squeezed.

The width and depth of the neck 128 can be sized to be large enough to allow the bottle contents to flow into the bulb without impediment. However, the width and depth of the neck can also be small enough so that the fluid does not have an easy path to flow back upwards when the bulb is squeezed. The contour of the fluid dispenser just above the neck can be tapered down into the neck to create a funnel. Gravity can pull the fluid down into the tip without impediment.

Figure 5A:
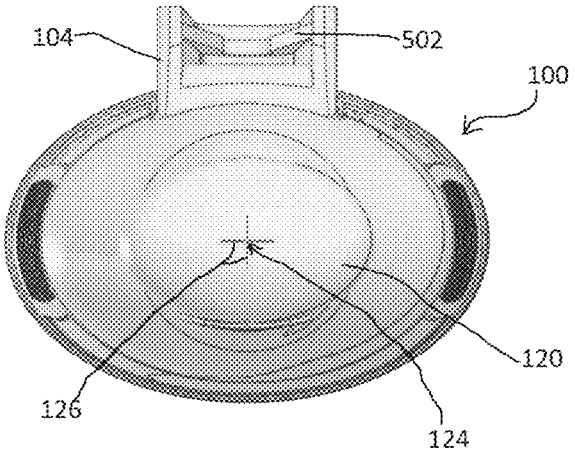
FIG. 5A is a bottom view of a fluid dispenser showing an alternative dispenser pore, according to an illustrative embodiment.
Figure 5B:
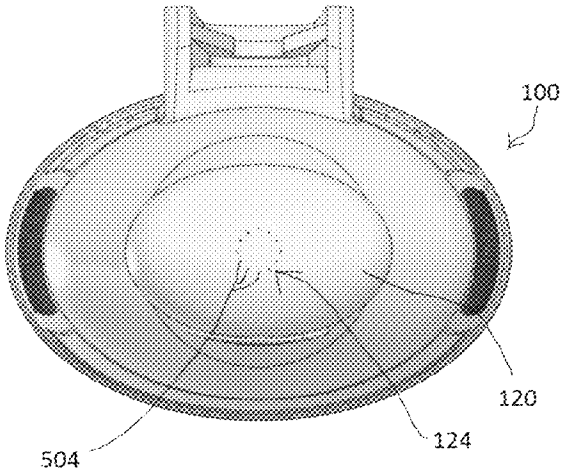
FIG. 5B is a bottom view of a fluid dispenser showing another alternative dispenser pore, according to an illustrative embodiment.

FIG. 5A is a bottom view of a fluid dispenser showing an alternative dispenser opening, according to an illustrative embodiment. A bulb can have a dispenser opening 124, and a dispenser opening 124 can have multiple slits 126. The slits 126 can be arranged transverse to each other, so that when the bulb is squeezed, the multiple slits can open to form a larger opening than a single slit. The angle between the slits can vary, so that the slits 126 can be perpendicular to each other, or form a different angle. The number of slits can vary, so that there may be more or less than two slits, and the slits can be arranged so that the angles between them are the same or different. Multiple slits can be parallel with each other, or otherwise separate from each other, so that there can be two distinct openings when the bulb is squeezed. A fluid dispenser 100 can have a suction cup mount 104, and a suction cup mount can have side rails 502. Side rails 502 can be configured to engage with a standard suction cup 103, explained more fully below. FIG. 5B is a bottom view of a fluid dispenser showing another alternative dispenser opening, according to an illustrative embodiment. A dispenser bulb 120 can have a dispenser pore 124 that can consist of multiple stoma 504 in the dispenser bulb 120. When the dispenser bulb 120 is squeezed, the flexible and stretchable material of the bulb can allow the multiple stoma 504 to open and dispense fluid.

Figure 6:
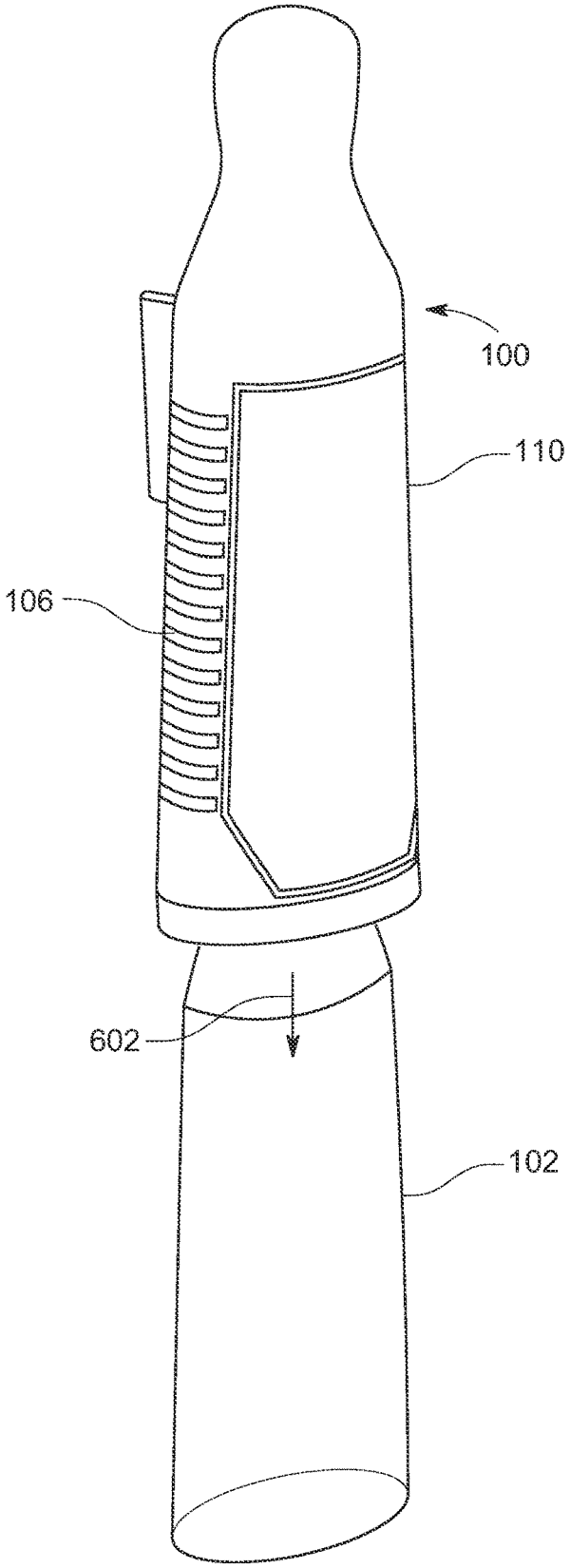
FIG. 6 is a perspective view of a bottle partially inserted into a fluid dispenser, according to an illustrative embodiment.

FIG. 6 is a perspective view of a bottle partially inserted into a fluid dispenser, according to an illustrative embodiment. A user can remove the cap from a bottle 102 before inserting the bottle into a fluid dispenser 100. With the bottle upright, the user can move the fluid dispenser 100 along direction arrow 602, thereby sliding the bottle holder 110 over the bottle 102, and thereby inserting the bottle 102 into the bottle pocket 112. Grips 106 can help a user to grip the sleeve during installation or removal of a bottle 102. The flexible and stretchy silicone sleeve can conform to the contours of a wide variety of sizes and shapes of bottles. When the bottle 102 is fully inserted into the bottle pocket, the bottle holder 110 can be wrapped snugly around the bottle. A user can then invert the fluid dispenser 100, and can attach the fluid dispenser to a surface such as a shower wall, tile, mirror, or other appropriate surface with a suction cup.

Figure 7A:
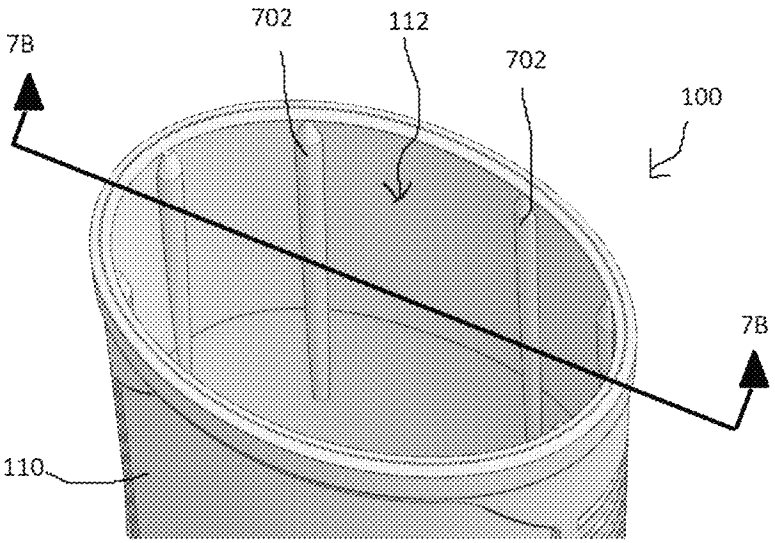
FIG. 7A is a perspective view of the top of a fluid dispenser with internal vertical ribs, according to an illustrative embodiment.
Figure 7B:
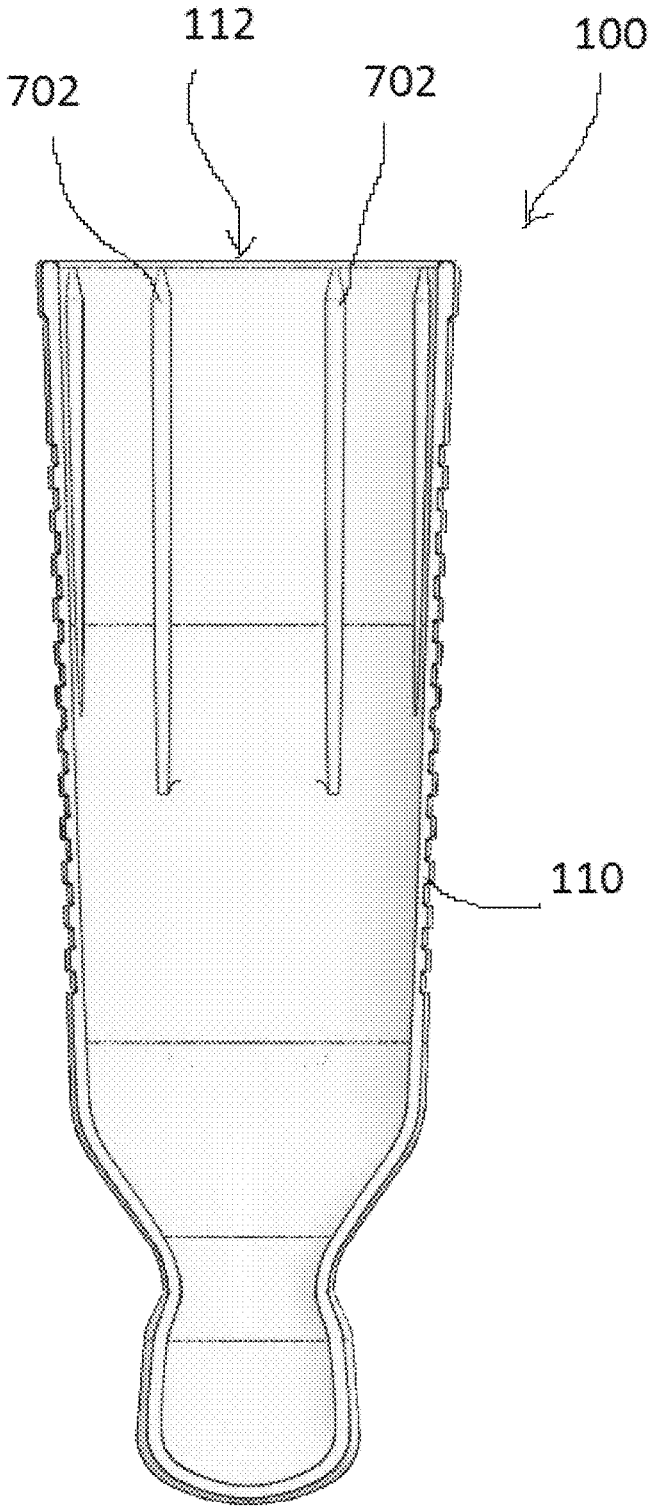
FIG. 7B is front cross section of the fluid dispenser with internal vertical ribs along line 7B-7B of FIG. 7A, according to an illustrative embodiment.

FIG. 7A is a perspective view of the top of a fluid dispenser with internal vertical ribs, according to an illustrative embodiment, and FIG. 7B is front cross section of the fluid dispenser with internal vertical ribs along line 7B-7B of FIG. 7A, according to the embodiment. A bottle holder 110 can have one or more internal vertical ribs 702. Vertical ribs 702 can make sliding the bottle into the bottle pocket easier. A bottle that is slid into the bottle pocket 112 of the embodiment shown in FIGS. 7A and 7B can slide along the vertical ribs 702. The vertical ribs 702 can decrease the friction between the bottle and the inner walls of the bottle pocket 112 because a portion of the side walls can be kept out of contact with the bottle by the vertical ribs 702. The vertical ribs 702 can decrease the contact area between the bottle and the side walls of the bottle pocket 112. The vertical ribs 702 can be limited to an upper portion of the bottle pocket, so that the lower portion of the bottle pocket can seal tightly around a bottle. The vertical ribs 702 can also allow air to escape as the bottle holder is slid over the bottle, so that air is not trapped within the fluid dispenser. Similarly, the vertical ribs 702 can allow air to flow into the bottle holder 110 when a bottle is removed from the bottle holder, so that the bottle is not held in place by a vacuum once the bottle is slid out of the sleeve to the internal region with the internal vertical ribs.

Figure 8A:
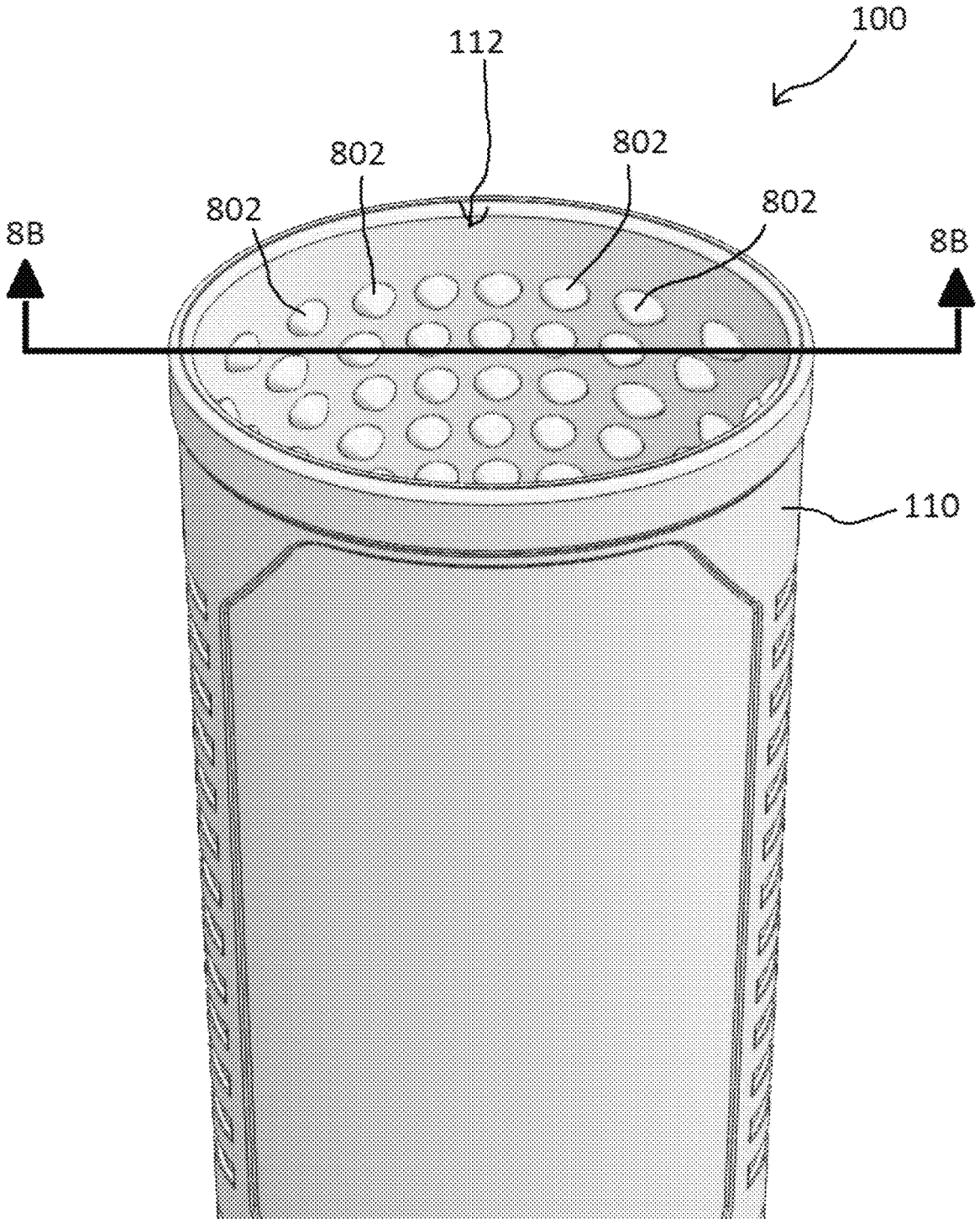
FIG. 8A is a perspective view of a fluid dispenser with internal bumps, according to an illustrative embodiment.
Figure 8B:
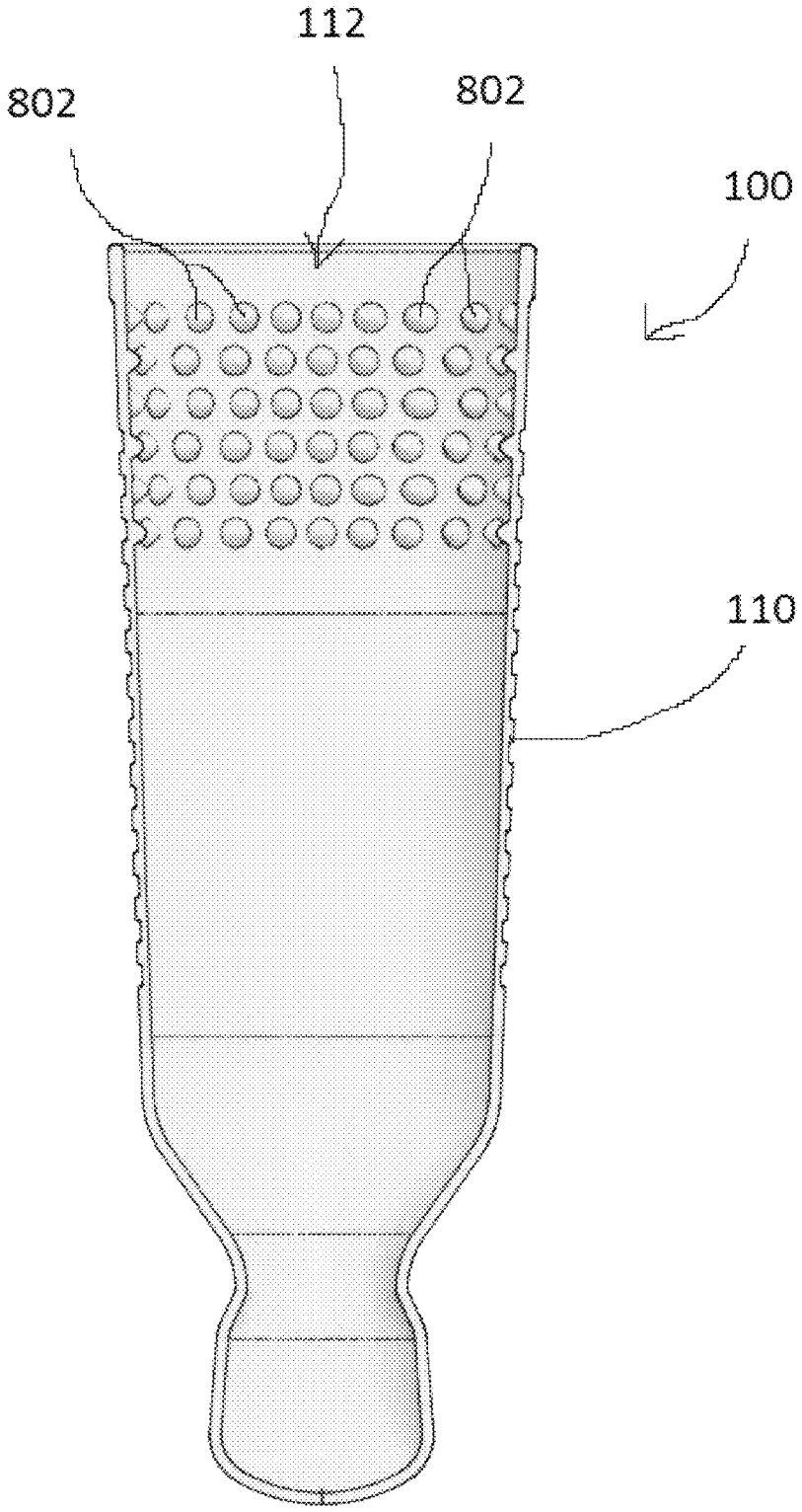
FIG. 8B is a front cross section of the fluid dispenser with internal bumps along line 8B-8B of FIG. 8A, according to an illustrative embodiment.

FIG. 8A is a perspective view of a fluid dispenser with internal bumps, according to an illustrative embodiment, and FIG. 8B is a front cross section of the fluid dispenser with internal bumps along line 8B-8B of FIG. 8A, according to the embodiment. A bottle holder 110 can have one or more internal bumps 802. Internal bumps 802 can make sliding the bottle into the bottle pocket easier. A bottle that is slid into the bottle pocket 112 of the embodiment shown in FIGS. 8A and 8B can slide along the internal bumps 802. The internal bumps 802 can decrease the friction between the bottle and the inner walls of the bottle pocket 112 because a portion of the side walls can be kept out of contact with the bottle by the internal bumps 802. The internal bumps 802 can decrease the contact area between the bottle and the side walls of the bottle pocket 112. The internal bumps 802 can be limited to an upper portion of the bottle pocket, so that the lower portion of the bottle pocket can seal tightly around a bottle. The internal bumps 802 can also allow air to escape as the bottle holder is slid over the bottle, so that air is not trapped within the fluid dispenser. Similarly, the internal bumps 802 can allow air to flow into the bottle holder 110 when a bottle is removed from the bottle holder, so that the bottle is not held in place by a vacuum once the bottle is slid out of the sleeve to the internal region with the internal vertical bumps.

Figure 9A:
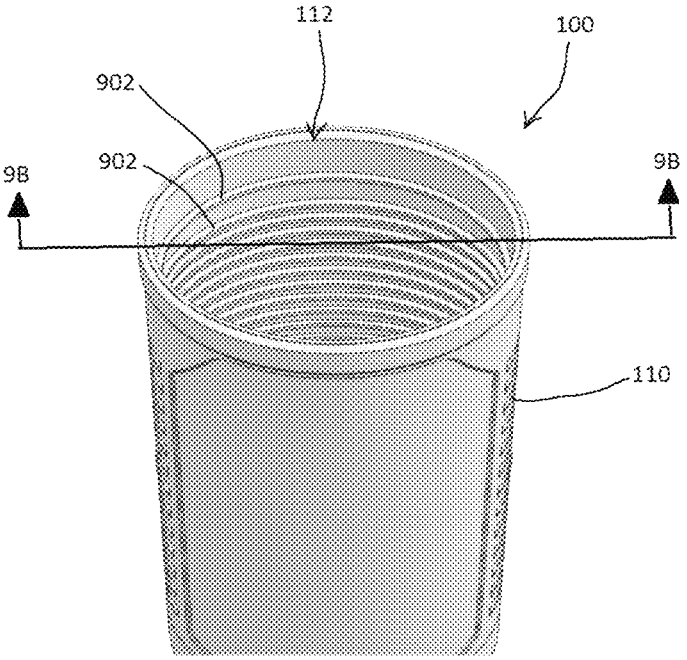
FIG. 9A is a perspective view of a fluid dispenser with internal rib rings, according to an illustrative embodiment.
Figure 9B:
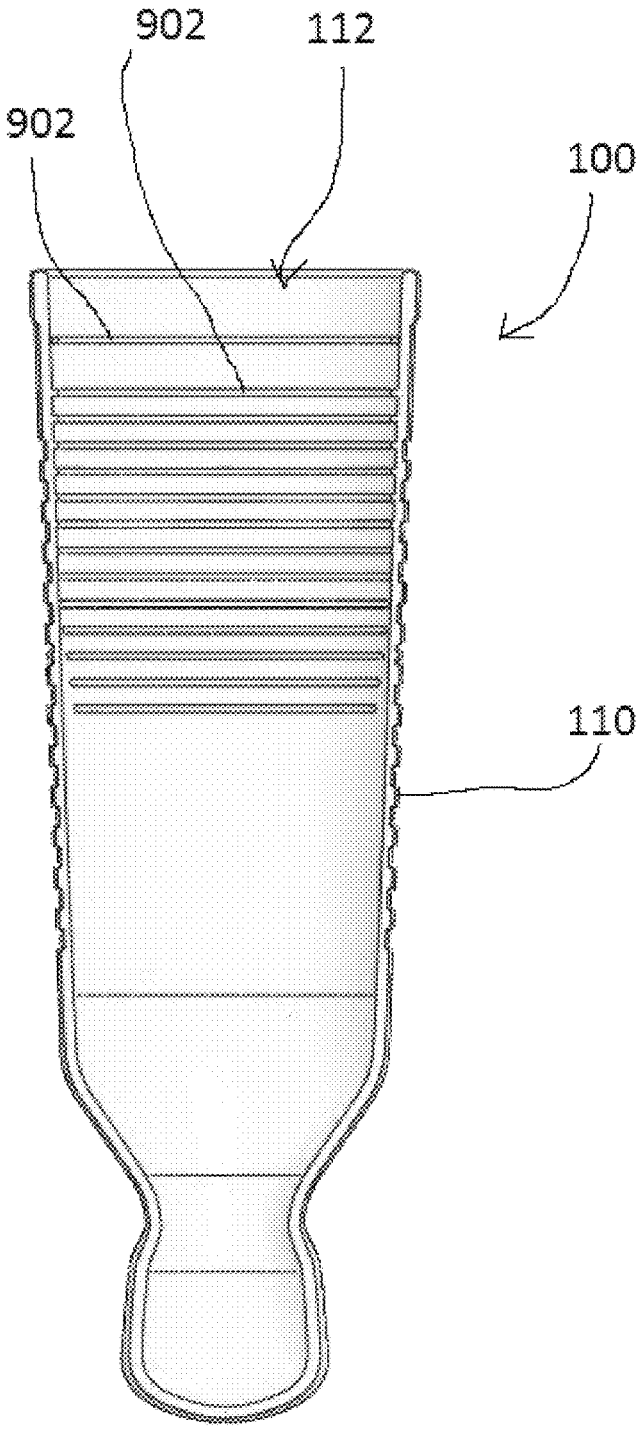
FIG. 9B is a front cross section of the fluid dispenser with internal rib rings along line 9B-9B of FIG. 9A, according to an illustrative embodiment.

FIG. 9A is a perspective view of a fluid dispenser with internal rib rings, according to an illustrative embodiment, and FIG. 9B is a front cross section of the fluid dispenser with internal rib rings along line 9B-9B of FIG. 9A, according to an illustrative embodiment. A bottle holder 110 can have one or more internal ring ribs 902. Internal ring ribs 902 can make sliding the bottle into the bottle pocket easier. A bottle that is slid into the bottle pocket 112 of the embodiment shown in FIGS. 9A and 9B can slide along the internal ring ribs 902. The internal ring ribs 902 can decrease the friction between the bottle and the inner walls of the bottle pocket 112 because a portion of the side walls can be kept out of contact with the bottle by the internal ring ribs 902. The internal ring ribs 902 can decrease the contact area between the bottle and the side walls of the bottle pocket 112. An individual internal ring rib 902 can help to form a seal between the bottle and the bottle holder, because an individual ring can make contact around the circumference of the bottle, while still allowing a decreased contact area between the bottle and the bottle pocket. The internal ring ribs 902 can be limited to an upper portion of the bottle pocket, so that the lower portion of the bottle pocket can seal tightly around a bottle. The internal ring ribs 902 can make it easier for air to escape as the bottle holder is slid over the bottle, because the decreased contact area between the bottle and the bottle pocket means the exiting air only needs to get past the smaller contact area between the rib rings and the bottle. Similarly, the internal rib rings 902 can make it easier for air to flow into the bottle holder 110 when a bottle is removed from the bottle holder, so that the bottle is not held in place by a vacuum once the bottle is slid out of the sleeve to the internal region with the internal rib rings.

In various embodiments, the internal surface of a bottle holder can have vertical ribs, internal bumps, horizontal rings, various surface textures that can include matte or textured surfaces, repeating surface patterns, rough textures, cross-hatches, zig-zag texture lines, blind holes, through holes, and/or other various other surface treatments to the interior surface of the bottle holder. Various possible surface treatments, alone or in combination, could help with the removal of a bottle for the same reasons as explained above in regard to the exemplary internal surfaces described in regard to FIGS. 8A-9B, including allowing air to enter and/or escape from the fluid dispenser as a bottle is inserted or removed from the fluid dispenser. In various embodiments, different regions of a bottle holder can have different surface textures. Regions of glossed or smooth surface finishes can be used to promote grip between the silicone sleeve and a bottle. Regions of glossed or smooth surface finishes can include regions around the window that can help to prevent puckering of the material when the material is stretched around a bottle, and/or regions around the top rim of the sleeve that can help to keep the bottle seated in the bottle dispenser. The exemplary surface treatments for the interior of the bottle holder that are described herein are intended only as examples, and various surface treatments are specifically contemplated for the interior of the bottle holder, including but not limited to the ones named herein. Furthermore, in various embodiments, the external surface of a fluid dispenser can have vertical ribs, internal bumps, horizontal rings, various surface textures that can include glossy or polished textures, repeating surface patterns, rough textures, cross-hatches, zig-zag texture lines, blind holes, through holes, and/or other various other surface treatments to the exterior surface of the fluid dispenser. Various outer surface textures or treatments can improve aesthetics and/or increase friction to help the user grip the outer surface. Various possible surface treatments, alone or in combination, could be beneficial on the outside of the fluid dispenser to improve the user's grip on the fluid dispenser as the user is inserting or removing a bottle. The exemplary surface treatments for the exterior of the fluid dispenser that are described herein are intended only as examples, and various surface treatments are specifically contemplated for the exterior of the fluid dispenser, including but not limited to the ones named herein.

Figure 10:
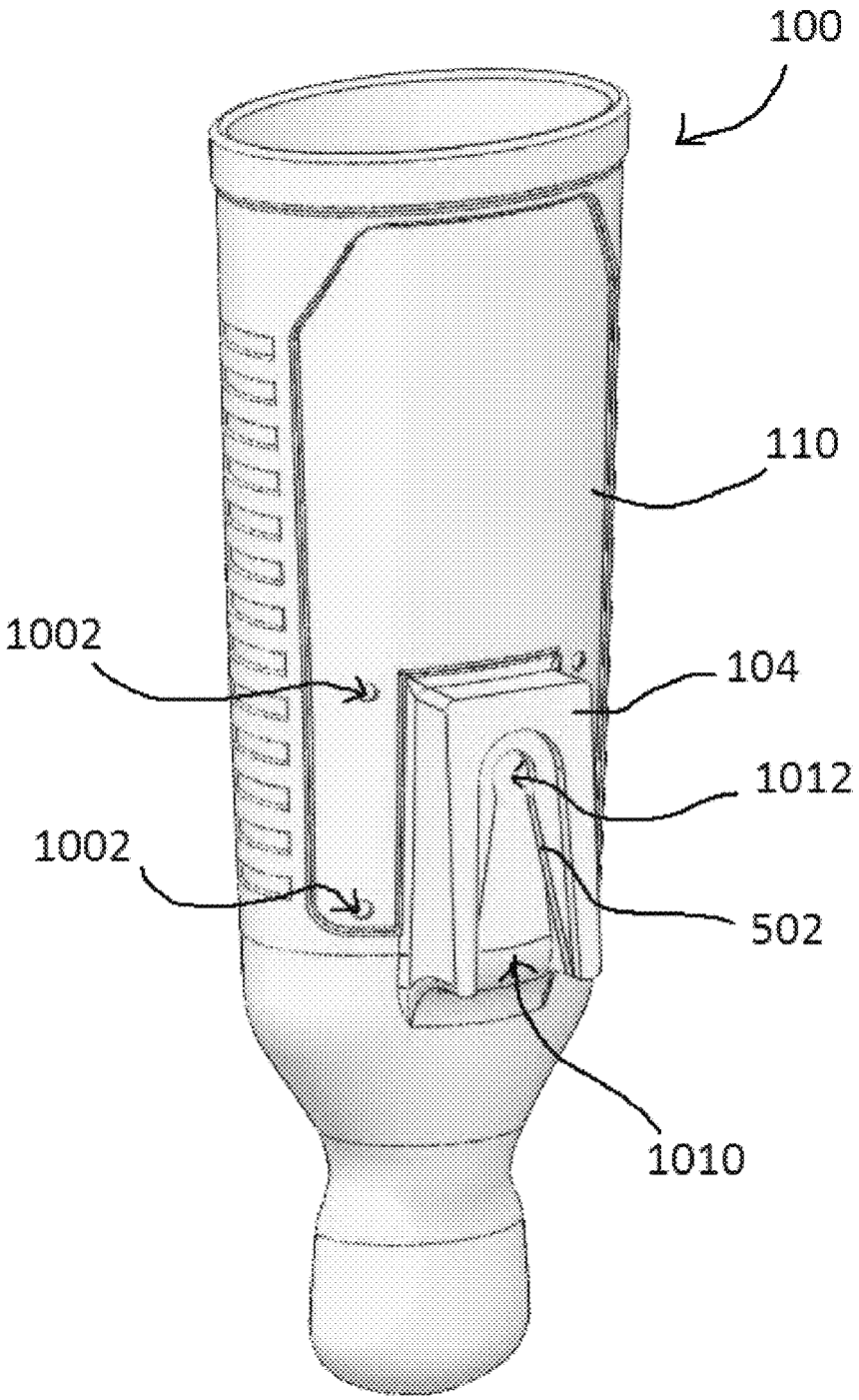
FIG. 10 is a rear perspective view of a fluid dispenser with air release holes, according to an illustrative embodiment.

FIG. 10 is a rear view of a fluid dispenser with air release holes, according to an illustrative embodiment. A fluid dispenser can have air release holes 1002. Air release holes can allow air to escape through the air release holes 1002 when a bottle 102 is being inserted into the bottle holder 110. Air can easily escape as the bottle is being inserted, however, when the bottle has been fully inserted, the bottle pocket can wrap snugly around the bottle 102, effectively closing the air release holes 1002. When a bottle is removed from a fluid dispenser, a user can pull slightly on the suction cup mount 104, which can pull the side wall of the bottle pocket away from the bottle, and can allow air to enter the bottle pocket through the air release holes 102. Allowing air to enter through the air release holes 1002 can release a vacuum between a bottle pocket and a bottle so that the bottle can be removed more easily once the bottle is slid out of the sleeve to the internal region with the air release holes.

Suction cup mount 104 can have a notch 1010. Notch 1010 can have a holding area 1012 and side rails 502. When viewed from the rear, side rails 502 can be angled so that notch 1010 can be wider at the base 1016, and notch 1010 can be narrower near the top 1018 of the suction cup mount 104. Side rails 502 can be farther apart near the base 1016, so that a user can more easily slide the fluid dispenser 100 over a suction cup nub. The side rails 502 can taper to a narrower area near the top 1018, so the side rails 502 can guide a suction cup nub into the holding area 1012 as a user places the fluid dispenser on the suction cup. Holding area 1012 can accommodate a nub of a standard suction cup 103.

Figure 11:
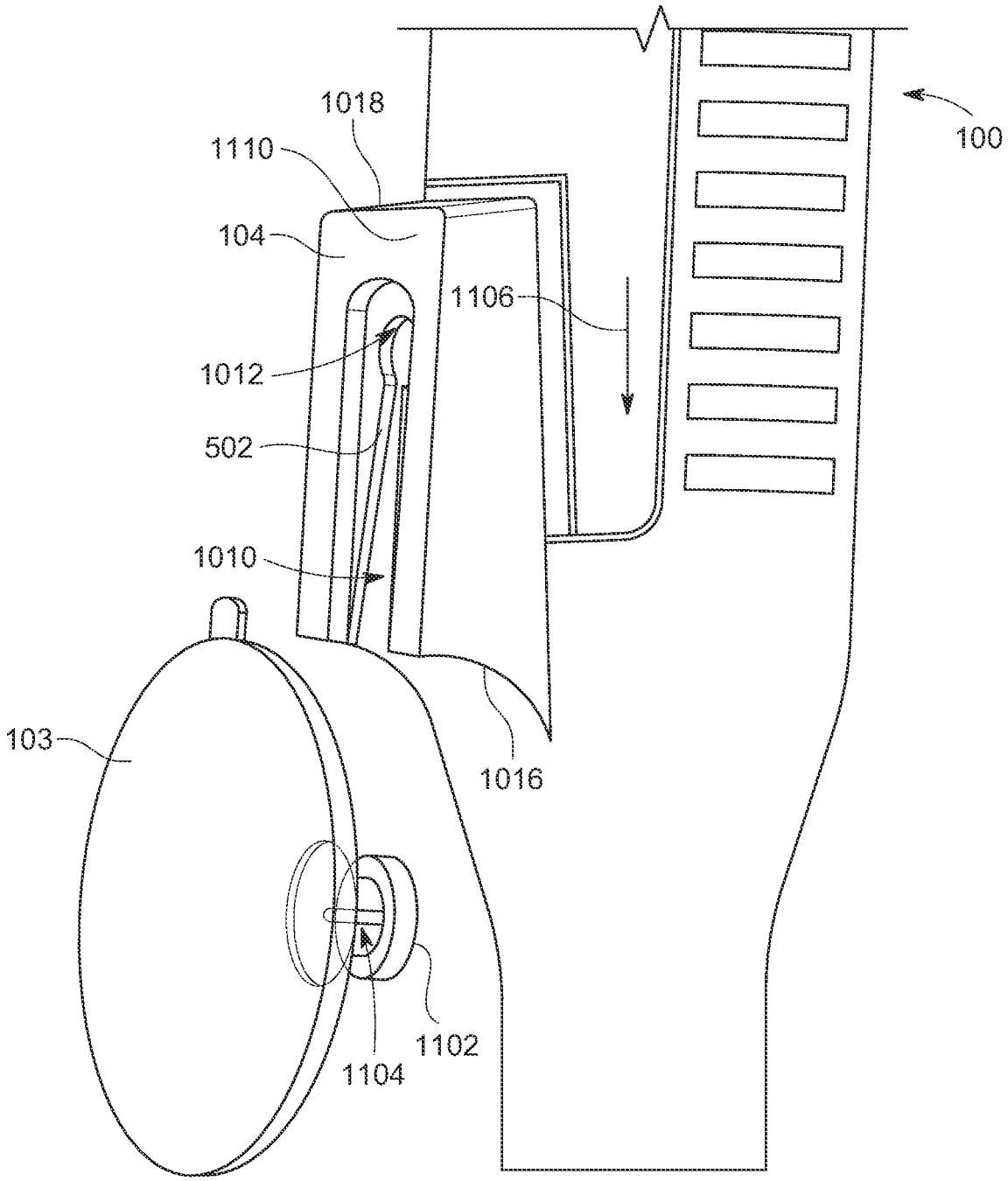
FIG. 11 is a perspective view of a suction cup mount of a fluid dispenser with a suction cup, according to an illustrative embodiment.

FIG. 11 is a perspective view of a suction cup mount of a fluid dispenser with a suction cup, according to an illustrative embodiment. Suction cup mount 104 can accommodate a standard-type suction cup. A standard suction cup 103 can have a nub 1102, and a gap 1104 separating the nub 1102 from the body of the suction cup. Side rails 502 can have a thickness that is approximately equal to, or slightly less than, the width of the gap 1104 on a suction cup. A user can place a fluid dispenser onto a suction cup by moving the fluid dispenser along direction arrow 1106, so that the nub 1102 of the suction cup can easily enter the notch 1010 that is conveniently wider near the base 1016. Side rails 502 can engage with the gap 1104, and the nub 1102 can be guided into the holding area 1012. A suction cup can be slid into the notch 1010, so that the fluid dispenser can be suspended from the suction cup. The notch 1010 is wider near the base 1016 so that a user can easily place the notch around the nub 1102 without needing to see the notch 1010 or nub 1102. Suction cup mount 104 can allow a user to remove a fluid dispenser from its location quickly and easily by lifting up on the fluid dispenser and disengaging the fluid dispenser from the suction cup while the suction cup can remain attached to the mounting surface. Because the suction cup can be a separate component that can remain attached to the mounting surface, the user can return the fluid dispenser to the position on the suction cup without having to press on the fluid dispenser to engage the suction cup to the mounting surface, and without having to risk any unwanted release of the contained fluid caused by pressing on the fluid dispenser.

The suction cup mount can be positioned so that the holding area 1012 can be at or above the center of gravity of the fluid dispenser in the dispensing position, so that the fluid dispenser can be maintained in the dispensing position when the fluid dispenser is hanging on the suction cup 103. The location of the holding area 1012 of the suction cup mount 104 at or above the center of gravity of the fluid dispenser can prevent the fluid dispenser from tipping forward or swiveling into an upside-down position with the dispensing bulb at the top. In an embodiment, the suction cup mount 104 is located approximately halfway up the fluid dispenser. This location can allow for weight distribution of the bottle on the mount so that it neither tips forward nor becomes susceptible to rotating or spinning around the axis of the suction cup. In various embodiments, a fluid dispenser can have more than one suction cup mount 104, and a fluid dispenser can hang from more than one suction cup 103.

When viewed from the side, the back face 1110 of the suction cup mount 104 can be angled so that it is farther away from the bottle holder 110 near the base, and closer to the bottle holder 110 near the top 1018. The suction cup mounting feature can have a partial wedge shape that can narrower at the top and wider at the base. This wedge shape of the suction cup mount can hold the bottom of the bottle holder out from the mounting surface. This wedge shape and resulting offset from the mounting surface can allow the user to comfortably position their hand around the bulb during dispensing. The wedge shape and resulting offset can help prevent the top of bottle holder 110 from tilting forwards away from the mounting surface when holding a heavy bottle. The suction cup mount can be sufficiently long and angled outward at the bottom to compensate for any flexing or compression of the material of the bottle holder when a heavy bottle is held in the bottle holder. In an exemplary embodiment, suction cup mount 104 can be approximately 0.369 inches thick near the top 1018, so the back face 1110 of the suction cup mount 104 can be approximately 0.369 inches from the bottle holder 110 near the top 1018. Suction cup mount 104 can be approximately 0.564 inches thick near the base 1016, so that the back face 1110 of the suction cup mount can be approximately 0.564 inches from the bottle holder 110 near the base 1016. In an exemplary embodiment, suction cup mount 104 can be approximately 2.000 inches long. In an exemplary embodiment, suction cup mount 104 can be approximately 1.100 inches wide. It should be clear that these suction up mount dimensions are exemplary, and various dimensions are possible without departing from the scope of the disclosure.

Figure 12:
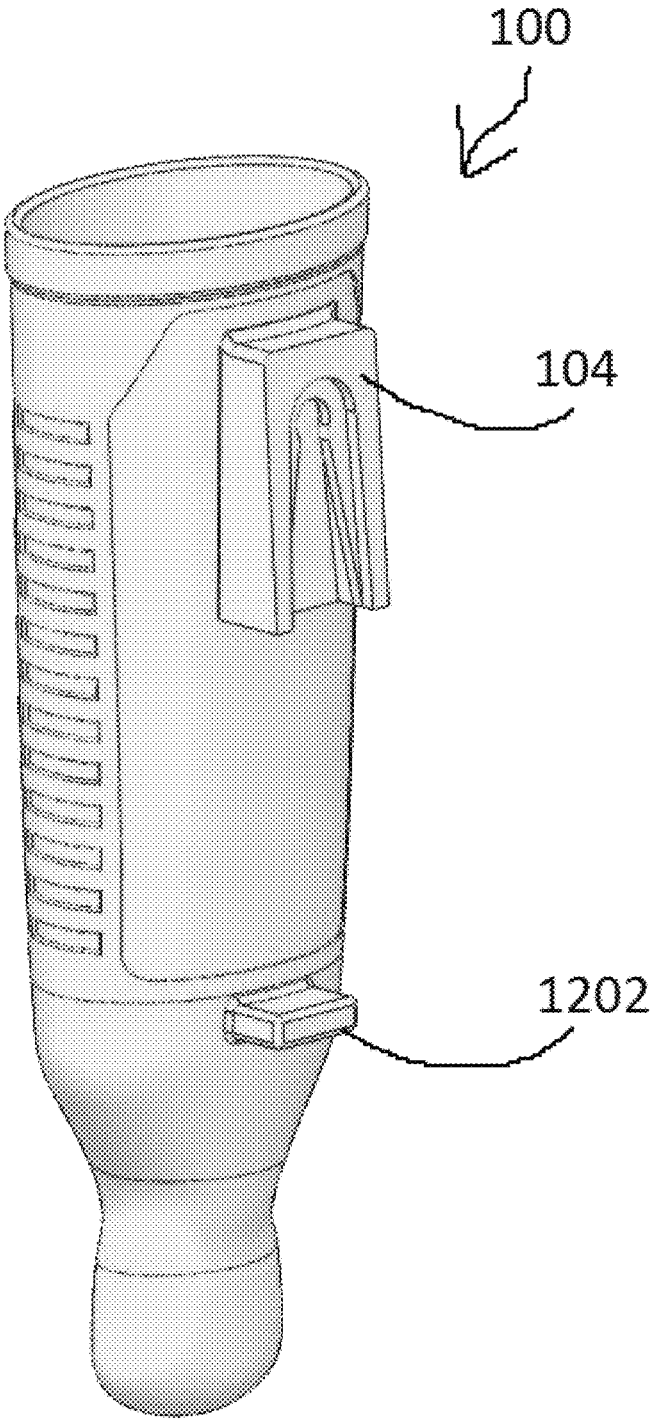
FIG. 12 is a perspective view of a fluid dispenser with a suction cup mount and a stand-off bump, according to an illustrative embodiment.

FIG. 12 is a perspective view of a fluid dispenser with a suction cup mount and a stand-off bump, according to an illustrative embodiment. A fluid dispenser 100 can have a suction cup mount 104 can be located at the same height as the center of gravity, or above the center of gravity of the fluid dispenser. In an embodiment, the suction cup can be mounted close to the top of the bottle holder, and a stand-off bump can be positioned between the suction cup mount and the bottom of the bottle. The stand-off bump can be positioned halfway up the overall length of the fluid dispenser. This can further help prevent the bottle from tipping forward or rotating around the suction cup axis. As shown in FIG. 12, a suction cup mount 104 can be located near the top of the fluid dispenser 100. A fluid dispenser with a suction cup mount 104 located at or near the top of the fluid dispenser can have a stand-off bump 1202. The stand-off bump can extend out from the back of the fluid dispenser a sufficient distance to create a gap between the fluid dispenser and the mounting surface. In an embodiment, the stand-off bump 1202 can extend outwards from the back of the fluid dispenser 100 approximately 0.433 inches, however, various dimensions for the stand-off bump are possible without departing from the scope of the disclosure. The stand-off bump 1202 can extend outwards enough to provide adequate clearance between the dispensing bulb and the mounting surface, so that a user's hand or fingers can easily fit between the dispensing bulb and the mounting surface.

Figure 13:
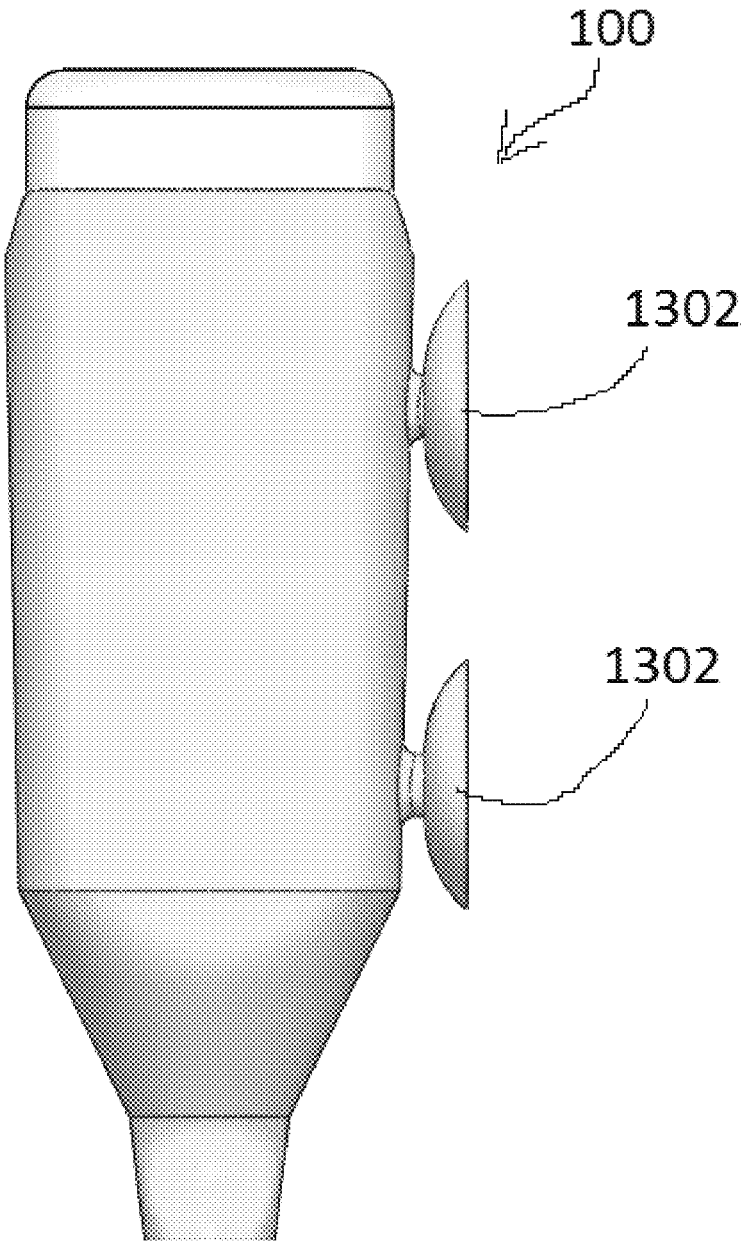
FIG. 13 is a side view of a fluid dispenser with integral suction cups, according to an illustrative embodiment.

FIG. 13 is a side view of a fluid dispenser with integral suction cups, according to an illustrative embodiment. A fluid dispenser 100 can have one or more integral suction cups 1302. Integral suction cups 1302 can be molded-in as an integral part of the fluid dispenser, and the fluid dispenser and integral suction cups can be a single piece.

Figure 14:
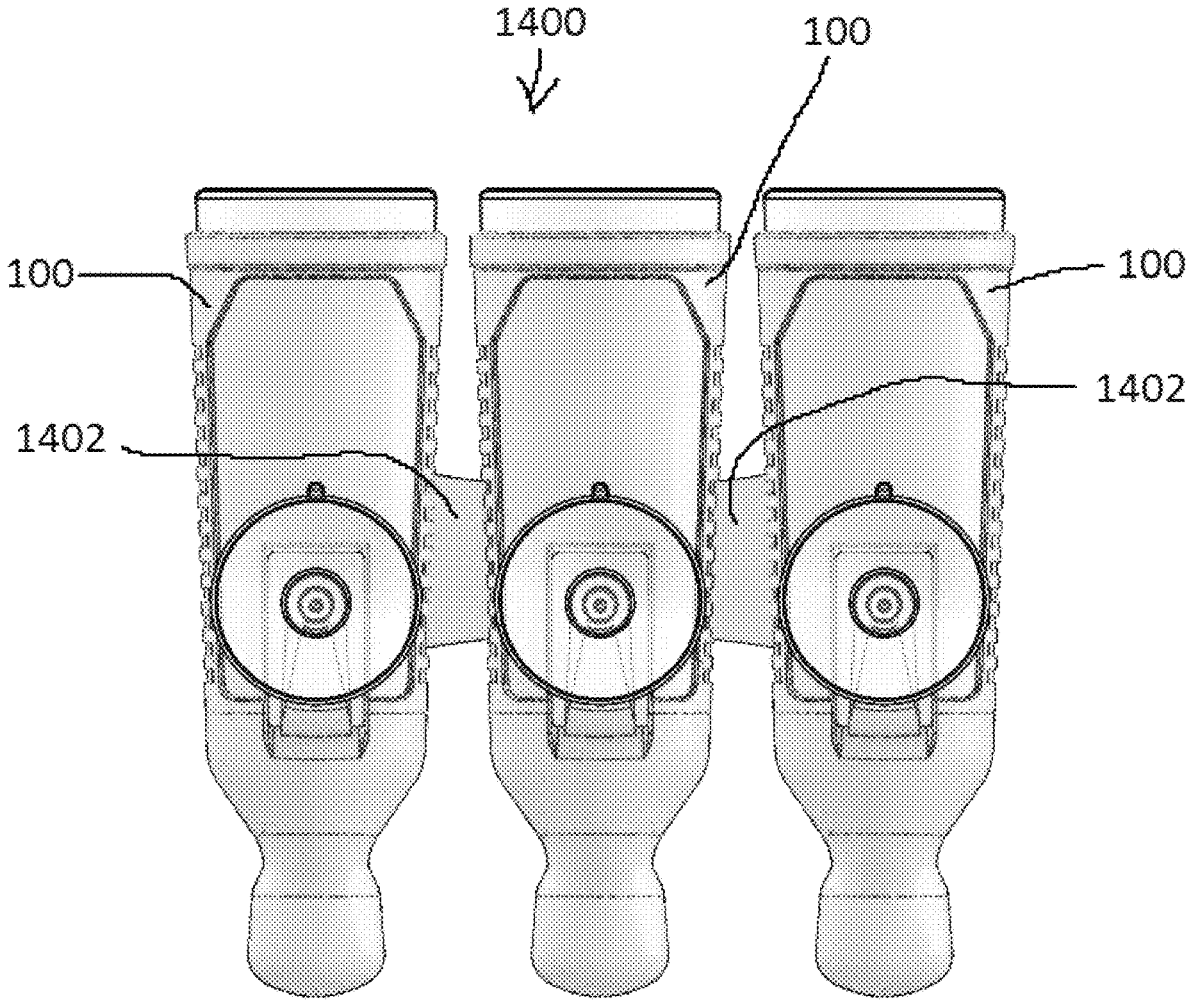
FIG. 14 is a rear view of a multi-dispenser unit, according to an illustrative embodiment.

FIG. 14 is a rear view of a multi-dispenser unit, according to an illustrative embodiment. A multi-dispenser unit 1400 can have multiple fluid dispensers 100 that can be joined together by connectors 1402. Each of the individual fluid dispensers can be individually supported by one or more separate suction cups, or the entire multi-dispenser unit can be supported by one or more suction cups that support the entire unit. With a multi-dispenser unit, a user can easily dispense fluids from several different bottles of fluid that can be maintained in close proximity and can help to support each other.

Figure 15A:
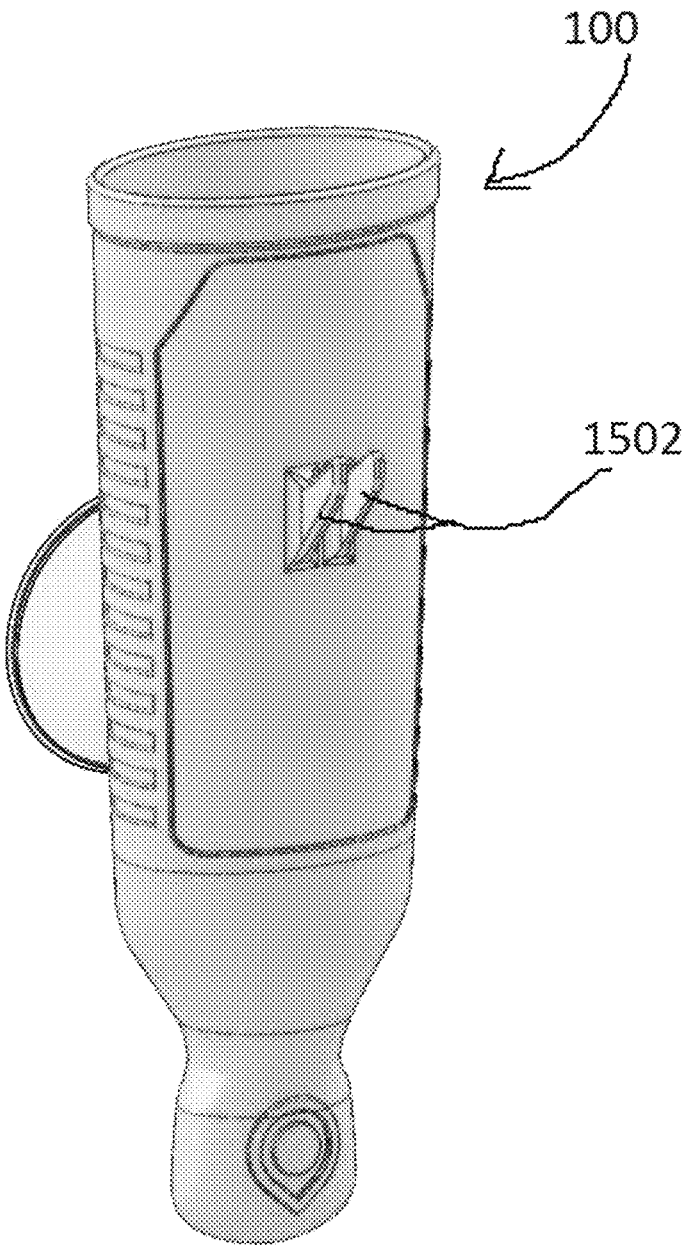
FIG. 15A is a perspective view of a fluid dispenser with integrated hooks, according to an embodiment.
Figure 15B:
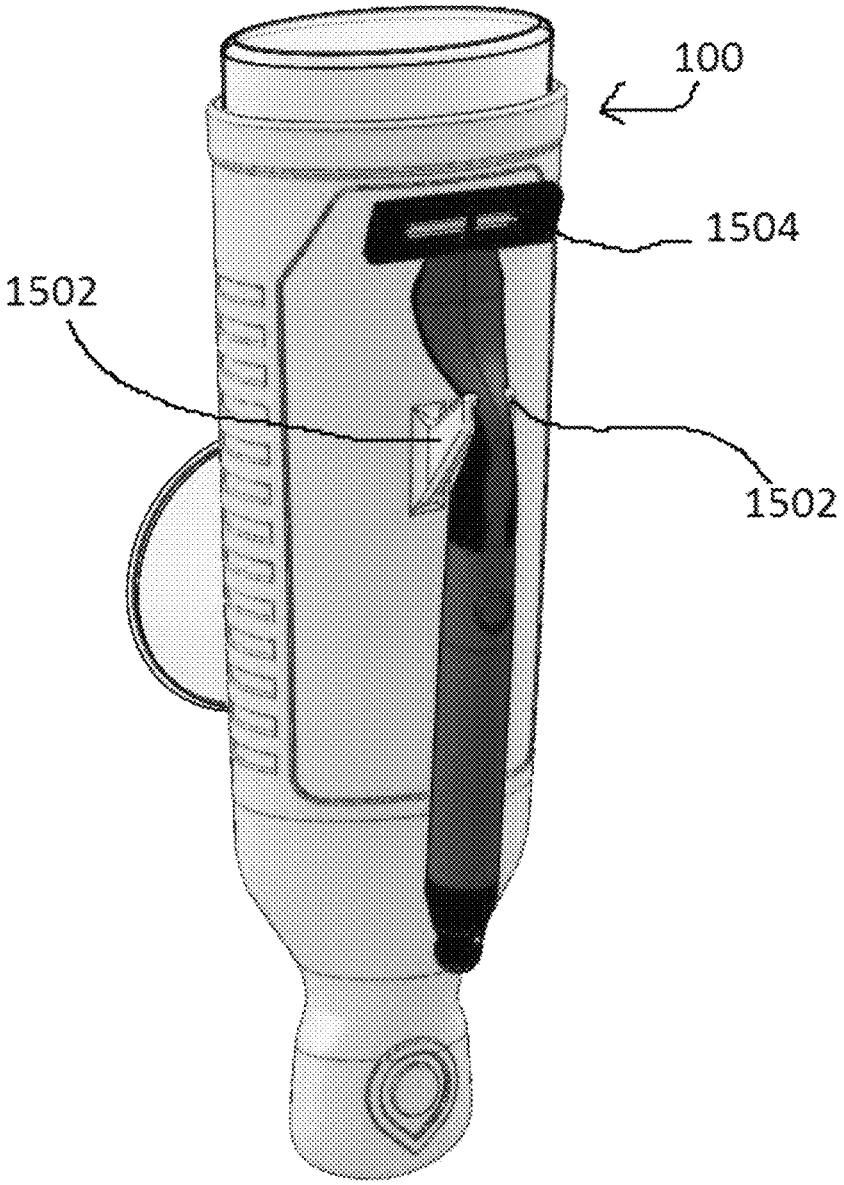
FIG. 15B is a perspective view of a fluid dispenser with a razor on the hooks, according to an illustrative embodiment.

FIG. 15A is a perspective view of a fluid dispenser with integrated hooks, according to an embodiment. A fluid dispenser can have at least one hook 1502. Hooks 1502 can be an integral part of the fluid dispenser, and can be molded-in as part of the fluid dispenser during manufacturing. FIG. 15B is a perspective view of a fluid dispenser with a razor 1504 hanging on the hooks 1502, according to an illustrative embodiment. Hooks 1502 can be designed to hold a razor, the string for a loofah, other shower accessories, or any other item that a user would like to store by hanging on the fluid dispenser. A fluid dispenser can have any number of hooks 1502 that can be located on the front and/or the side(s) of the fluid dispenser, so that various items can be suspended from the fluid dispenser.

FIG. 16 is a perspective view of a fluid dispenser with a cut-out window, according to an illustrative embodiment. A fluid dispenser 100 can be manufactured with one or more cut-out windows 1602 in the bottle holder 110. The cut-out window can be molded into the fluid dispenser, or the cut out window can be cut away after the fluid dispenser has been molded. The cut-out window 1602 can allow the user to view the bottle within the fluid dispenser, so that a user with multiple fluid dispensers can see which bottle is in which fluid dispenser. The cut-out window can make it easier for air to escape when a bottle is inserted into the fluid dispenser, or for air to flow in to release a vacuum when a bottle is removed from the fluid dispenser. The cut-out window can make insertion and removal of the bottle easier by decreasing the amount of friction between the bottle surface and the inside surface of the sleeve. The cut-out window can also be used for insertion and removal of a bottle. A bottle can be inserted or removed through the cut-out window.

Figure 16A:
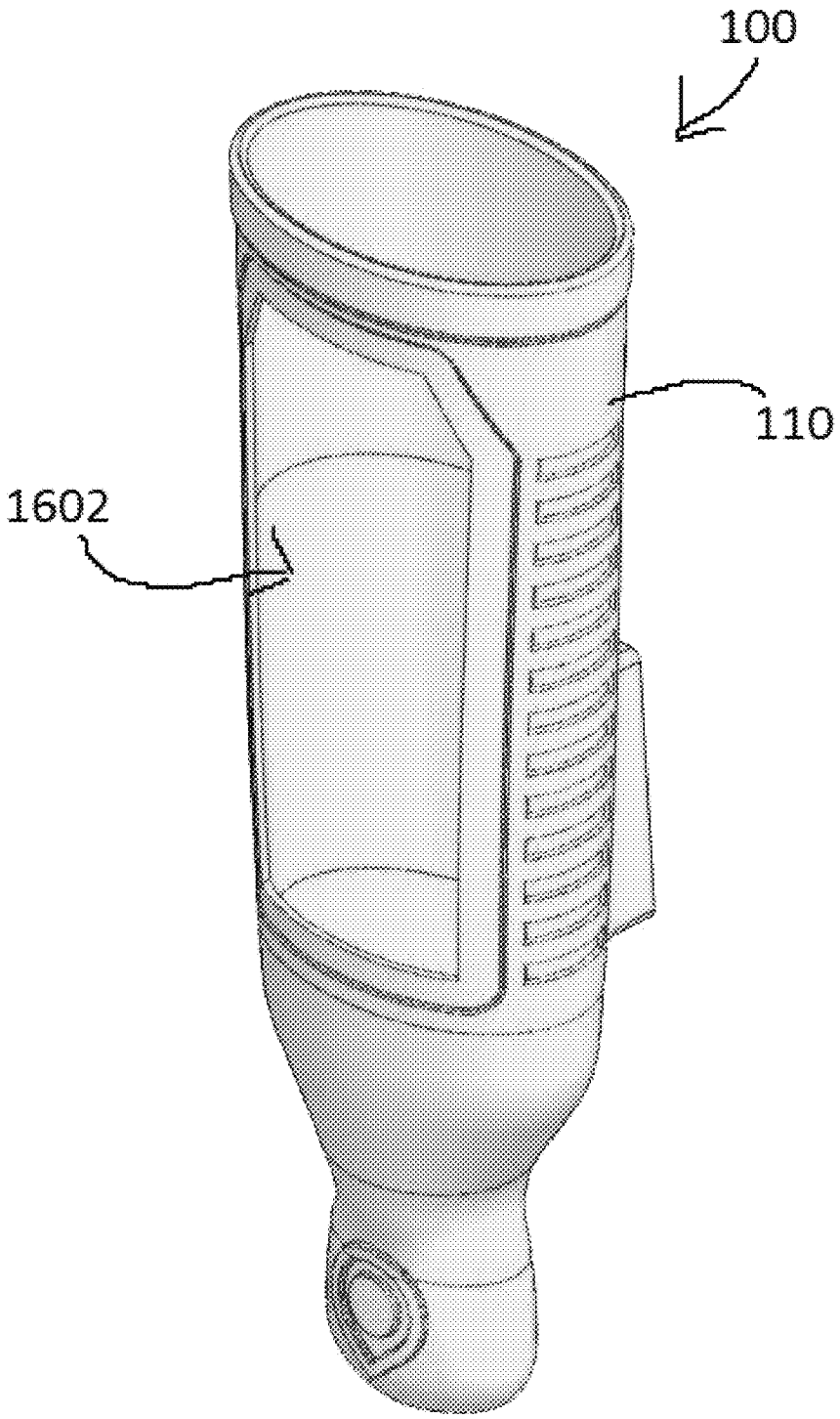
FIG. 16A is a perspective view of a fluid dispenser with a cut-out window, according to an illustrative embodiment.
Figure 16B:
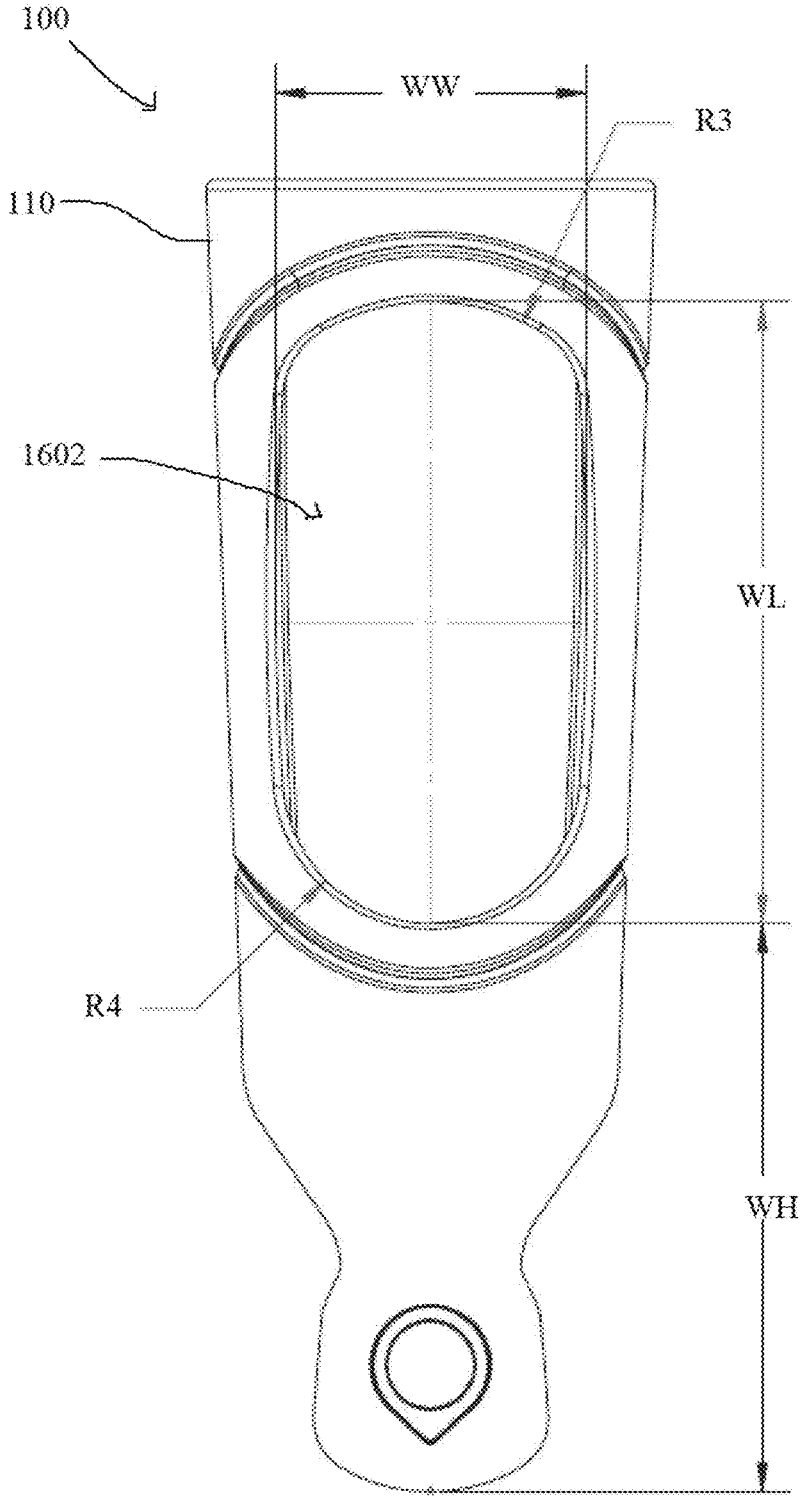
FIG. 16B is a front view of a fluid dispenser with a cut-out window showing dimensions, according to another illustrative embodiment.

FIG. 16B is a front view of a fluid dispenser with a cut-out window showing dimensions, according to another illustrative embodiment. A fluid dispenser 100 can have a cut-out window 1602 with a window length WL of approximately 4.2 inches. A fluid dispenser 100 can have a cut-out window 1602 with a window height from the bottom of the window to the bottom of the dispenser bulb WH of approximately 3.9 inches. A fluid dispenser 100 can have a cut-out window 1602 with a window width WW measured from one side of the window to the other side of the window of approximately 2.1 inches. A cut-out window 1602 can have an upper radius R3 of approximately 1.5 inches. A cut-out window 1602 can have a lower radius R4 of approximately 1 inch.

Figure 16C:
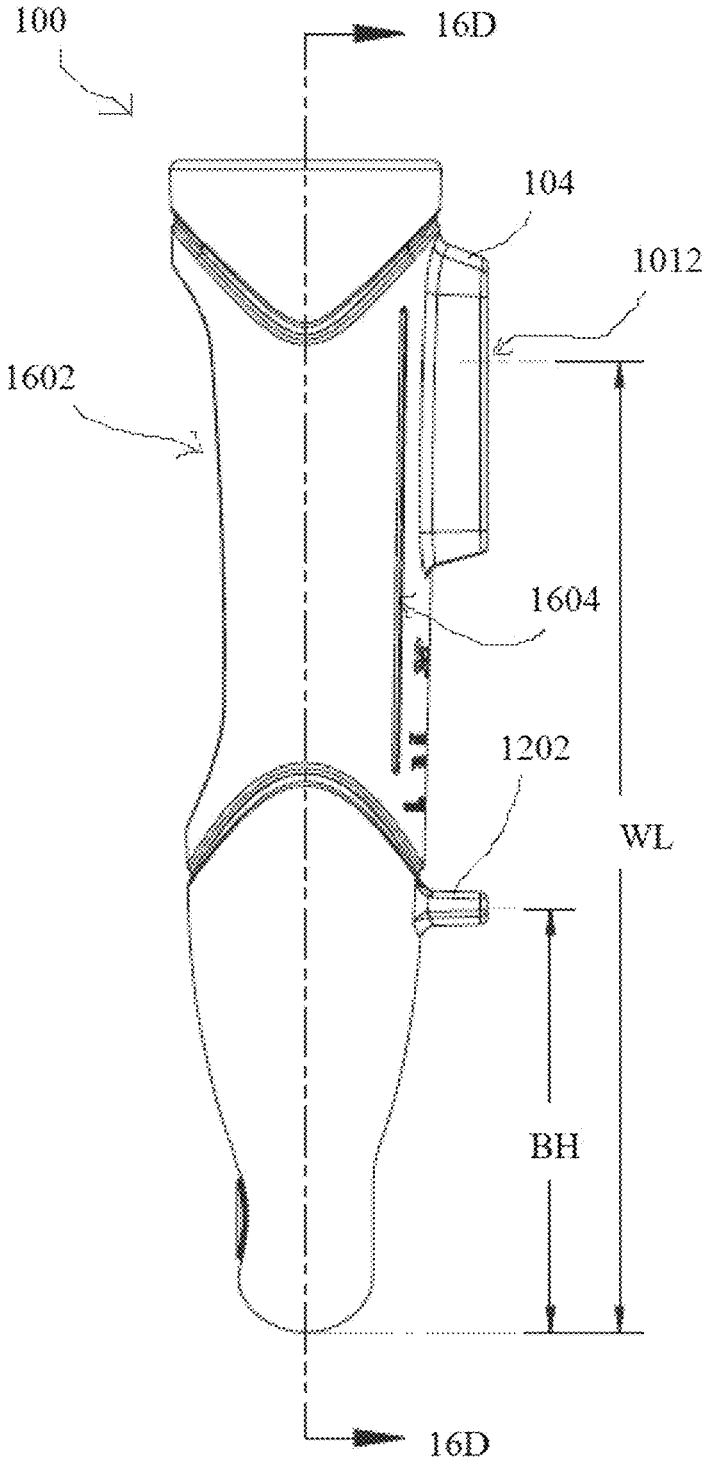
FIG. 16C is a side view of the fluid dispenser of FIG. 16B with a cut-out and relief slot, and showing dimensions, according to the illustrative embodiment.

FIG. 16C is a side view of the fluid dispenser of FIG. 16B with a cut-out and relief slot, and showing dimensions, according to the illustrative embodiment. A fluid dispenser 100 can have a window 1602, a stand-off bump 1202, a suction cup mount 104, and at least one relief slot 1604. Stand-off bump 1202 can have a stand-off bump height BH from the stand-off bump to the bottom of the bulb of approximately 3.2 inches. Suction cup mount 104 can have a holding area 1012 that can be above the center of gravity of the fluid dispenser, so that more than half of the weight of the fluid dispenser, bottle, and fluid can be below the holding area 1012. Holding area 1012 can be near the top of the fluid dispenser. Holding area 1012 can have a holding area height HH from the holding area to the bottom of the bulb of approximately 7.4 inches.

At least one relief slot 1604 can be located at the back or side(s) of the bottle holder, and can allow the bottle holder 110 to conform to the shape of a bottle without deformation of the bottle holder 110. The relief slot(s) 1604 can flex open to allow the circumference of the bottle holder to expand and accommodate a bottle, thereby relieving stress on the material of the bottle holder 110. The relief slot(s) 1604 can minimize or eliminate deformation of the bottle holder, including puckering of the material at the edge of the window, as a bottle is held within the bottle holder. The relief slot(s) 1604 can also allow a bottle to be inserted into the bottle holder more easily as the slots flex open and allow the circumference of the bottle holder to expand and accommodate a bottle. The relief slot(s) 1604 can be approximately the same length as the window length WL, and the relief slots 1604 can be rounded at the top and bottom of the relief slot(s) 1604 to prevent tearing of the slot(s) as the slot(s) are flexed open.

Figure 16D:
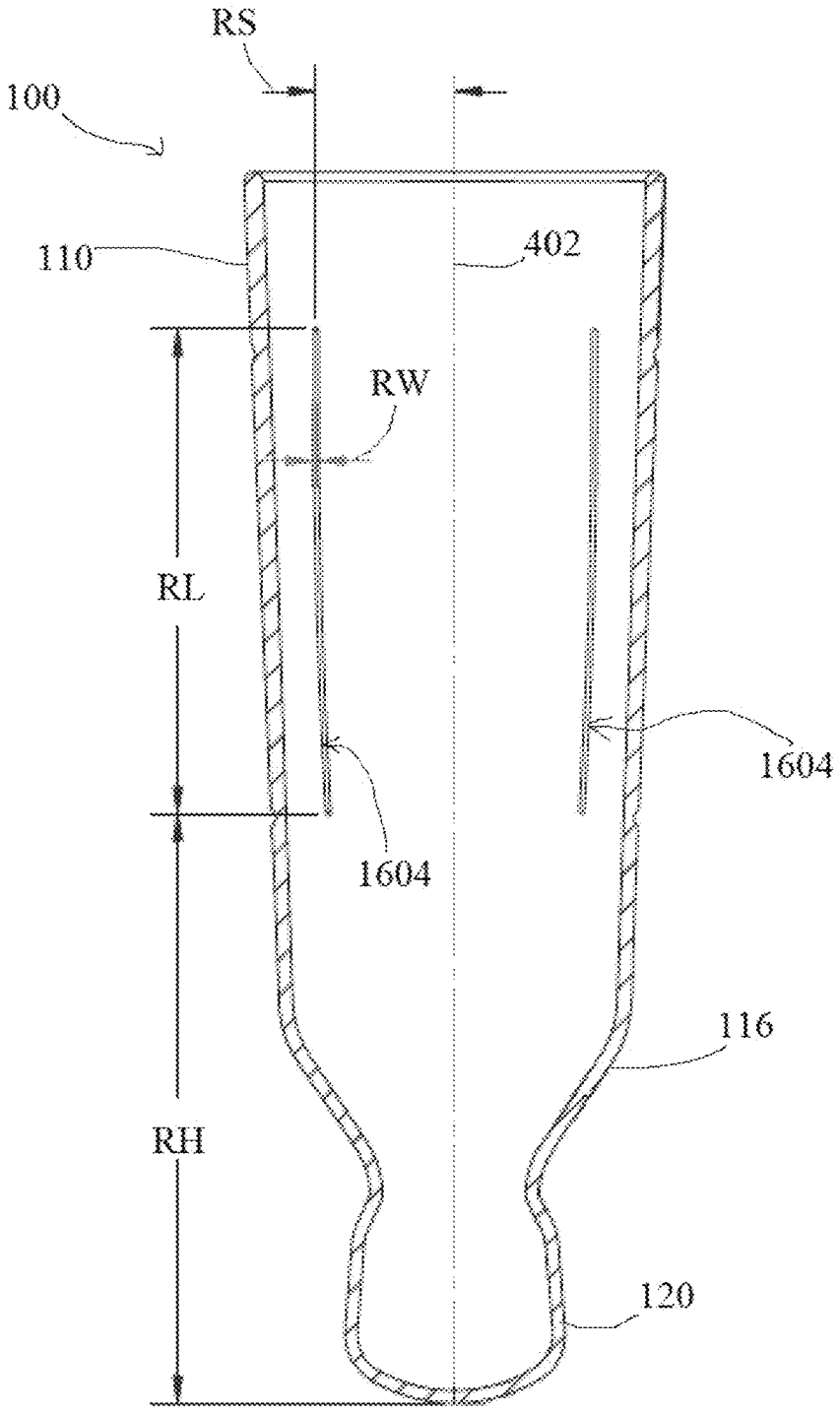
FIG. 16D is a cross-section view of the bottle holder of FIG. 16C, taken along cross-section line 16D-16D of FIG. 16C, showing the rear portion of the fluid dispenser with relief slots and dimensions, according to the illustrative embodiment.

FIG. 16D is a cross-section view of the bottle holder of FIG. 16C, taken along cross-section line 16D-16D of FIG. 16C, showing the rear portion of the fluid dispenser with relief slots and dimensions, according to the illustrative embodiment. A fluid dispenser 100 can have a bottle holder 110, shoulders 116, a bulb 120, and at least one relief slot 1604. A relief slots 1604 can have a relief slot length RL from the top of the slot to the bottom of the slot of approximately 3.5 inches. Relief slots 1604 can have a relief slot height RH from the bottom of the slot to the bottom of the bulb 120 of approximately 4.3 inches. A relief slot 1604 can have a relief slot width RW of approximately 0.04 inches. A bottle holder 110 can have one, two, or more relief slots 1604 in various embodiments. In an embodiment, a bottle holder 110 can have two relief slots 1604, and the relief slots 1604 can be located approximately parallel to the central axis 402, and the relief slots can have a relief slot spacing RS from the relief slot 1604 to the central axis 402 of approximately 1 inch. It should be obvious that the above dimensions are provided as a non-limiting example, and are not intended to limit the scope of the present disclosure.

Figure 17:
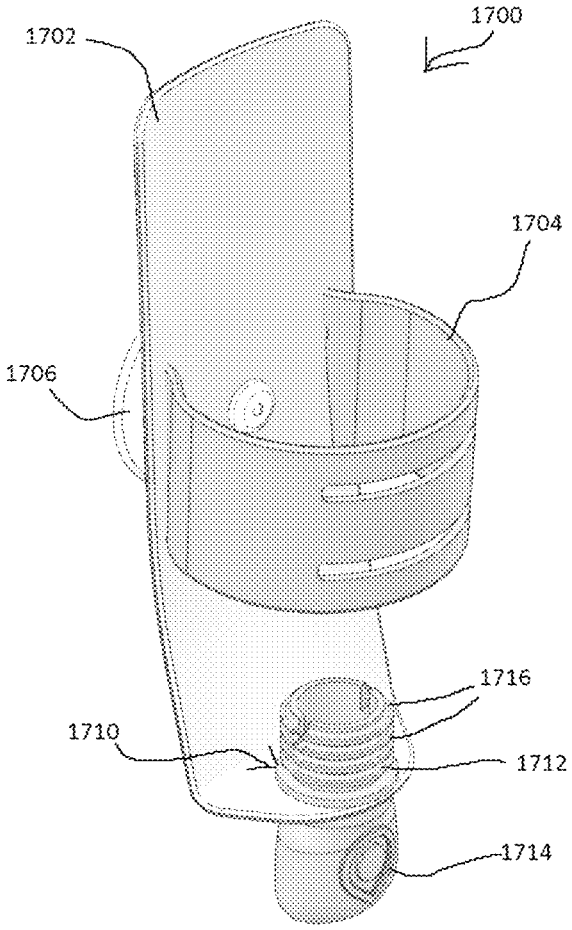
FIG. 17 is a perspective view of a bottle holster, according to an illustrative embodiment.

FIG. 17 is a perspective view of a bottle holster, according to an illustrative embodiment. A bottle holster 1700 can have a support spine 1702, a strap 1704, a suction cup 1706, and a dispenser 1710. The strap 1704 can hold a bottle in the bottle holster 1700. The strap 1704 can be a flexible and/or stretchable material that can be made of a silicone material, such as the silicone materials described above. Dispenser 1710 can have an insertion portion 1712 and a dispenser bulb 1714. Insertion portion 1712 can be designed to fit inside of the neck of a bottle. Insertion portion 1712 can have insertion rings 1716. Insertion rings 1716 can be made of a flexible material such as silicone, described above. The insertion rings can create a seal between the insertion portion 1712 and the interior of the neck of a bottle. Because the insertion rings 1716 are made of a flexible material such as silicone, they can create a seal between the insertion portion 1712 and various different sized bottle necks. Insertion rings 1716 can extend outwards from insertion portion 1712, and can be compressed inwards and/or flexed downwards as insertion portion 1712 is inserted into a bottle neck. Dispenser bulb 1714 can have a reservoir and a dispenser pore as described above. The dispenser bulb 1714 can operate the same as the dispenser bulb explained above. A support spine can be configured to hold multiple bottles 102 and multiple dispensers 1710. A support spine can have multiple straps 1704.

Figure 18:
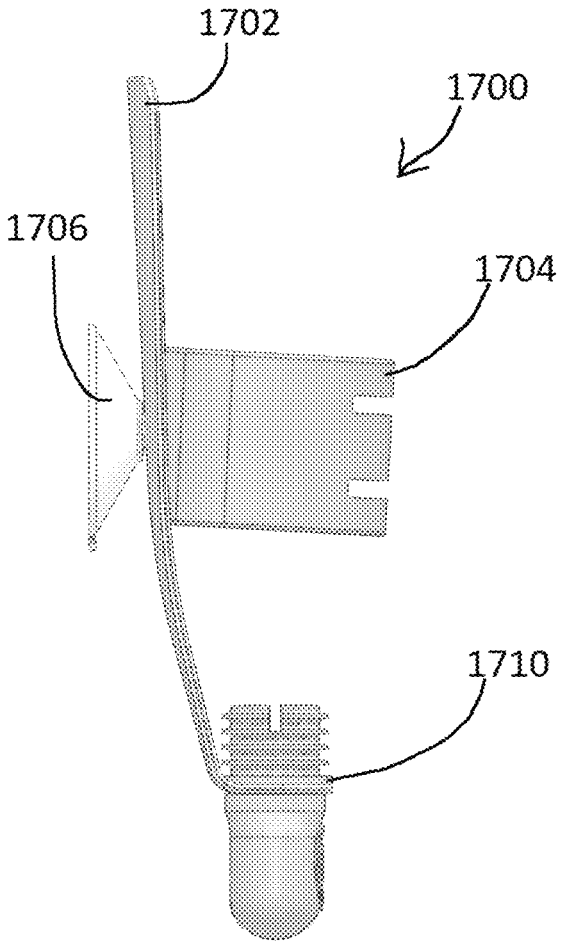
FIG. 18 is a side view of a bottle holster, according to an illustrative embodiment.

FIG. 18 is a side view of a bottle holster, according to an illustrative embodiment. The dispenser 1710 can be mounted in the support spine 1702. The suction cup 103 can be affixed to the support spine 1702. The support spine can be curved, and the support spine can be a rigid or semi-flexible material such as a plastic that can hold the suction cup 1706, strap 1704, and dispenser 1710 in the correct positions.

Figure 19:
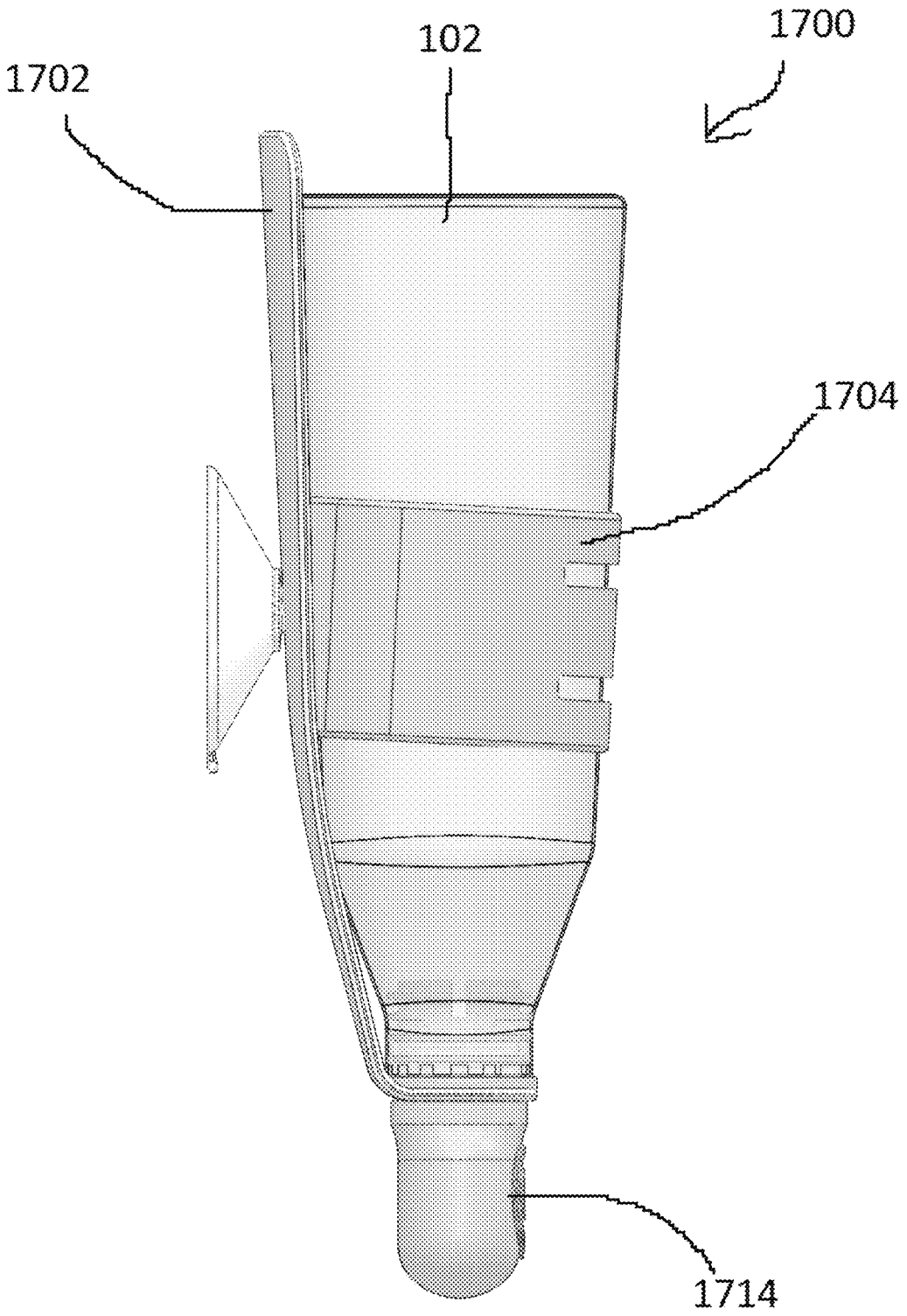
FIG. 19 is a side view of a bottle holster with an inserted bottle, according to an illustrative embodiment.

FIG. 19 is a side view of a bottle holster with an inserted bottle, according to an illustrative embodiment. The strap 1704 can hold the bottle 102 in the bottle holster 1700. The bottle holster can hold the bottle in the inverted position so that fluid flows downward into the dispenser bulb. The dispenser bulb 1714 can allow a user to dispense fluid from the bottle 102. The spine can hold the bottle and the dispenser bulb such that a gap exists between the dispenser bulb and the mounting surface. The spine 1704 can be held in place by the suction cup, and the top of the spine 1702 can contact the mounting surface. The rigid or semi-flexible spine that is held in place by the suction cup in one location, and can be held against the mounting surface in a second location, can hold the dispensing bulb away from the mounting surface to provide adequate clearance between the dispensing bulb and the mounting surface so that a user's hand or fingers can easily fit between the dispensing bulb and the mounting surface.

Figure 20:
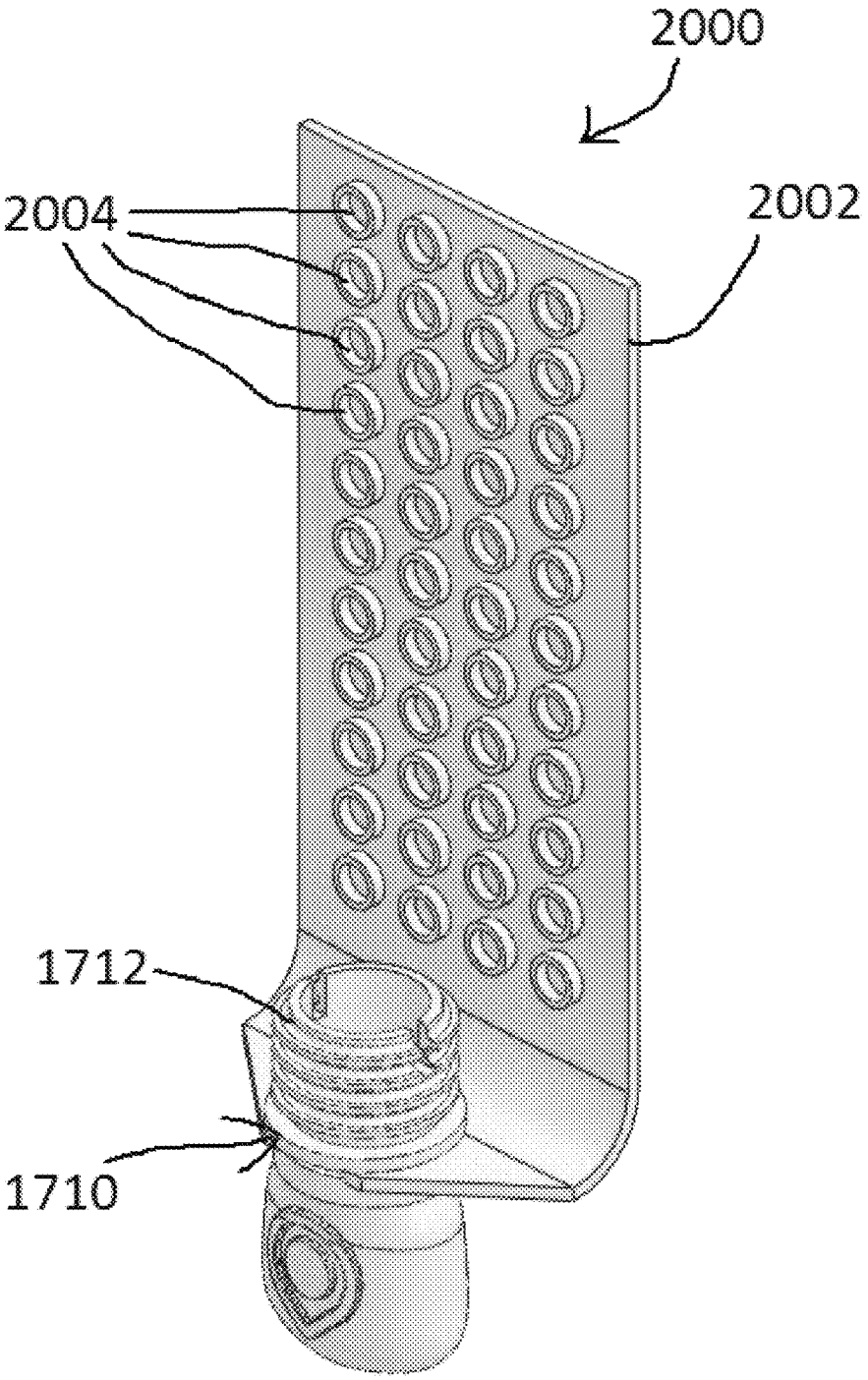
FIG. 20 is a perspective view of a bottle holster with multiple suction cups, according to an illustrative embodiment.

FIG. 20 is a perspective view of a bottle holster with multiple suction cups, according to an illustrative embodiment. A bottle holster 2000 can have a rigid or semi-flexible spine 2002 and a multitude of integral suction cups 2004. A bottle holster 2000 with multiple integral suction cups can be free of a strap. The bottle holster 2000 can have a dispenser 1710 that is held by the rigid or semi-flexible spine 2002. A bottle can be held in place by at least one of the multitude of integral suction cups 2004 that can grip and hold the bottle. A bottle can also be held in place by the insertion member 1712 of the dispenser 1710. The insertion member can be inserted within the neck of the bottle, and the bottle and dispenser can both be supported by the rigid or semi-flexible spine.

Figure 21:
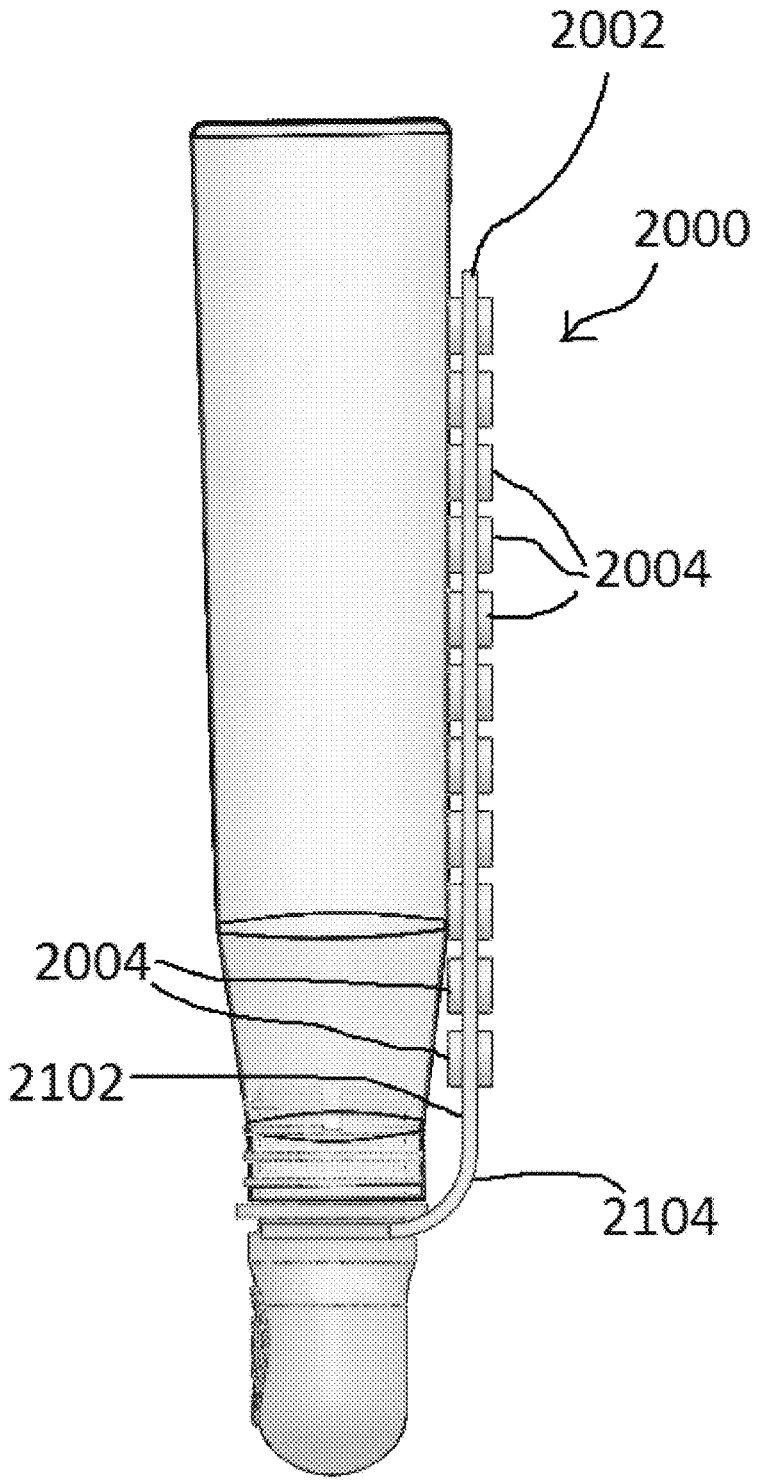
FIG. 21 is a side view of a bottle holster with multiple suction cups holding a bottle, according to the embodiment.

FIG. 21 is a side view of a bottle holster with multiple suction cups holding a bottle, according to an illustrative embodiment. A bottle holster 2000 with multiple suction cups 2004 can have multiple suction cups 2004 on the front side 2102 of the spine 2002, and the bottle holster 2000 can have multiple suction cups on the back side 2104 of the spine 2002. The suction cups 2004 on the front side can help to hold the bottle in place, and the suction cups 2004 on the back side 2104 can secure the bottle holster to a mounting surface such as a shower wall.

The foregoing has been a detailed description of illustrative embodiments of the invention. Various modifications and additions can be made without departing from the spirit and scope of this invention. Features of each of the various embodiments described above may be combined with features of other described embodiments as appropriate in order to provide a multiplicity of feature combinations in associated new embodiments. Furthermore, while the foregoing describes a number of separate embodiments of the apparatus and method of the present invention, what has been described herein is merely illustrative of the application of the principles of the present invention. For example, in alternate embodiments, a dispenser opening can be on the front of a dispenser bulb instead of the bottom. A bottle holster can have a dispenser bulb with a neck region that fits around the outside of the neck of the bottle, in addition to, or instead of, having an insertion portion that is inserted into the neck of the bottle. A neck region that fits around the outside of the neck of the bottle can extend around the neck of the bottle or can extend upwards to cover a larger portion of the bottle, and can form a tight seal with the neck and/or higher portion of the bottle. Also, as used herein, various directional and orientational terms (and grammatical variations thereof) such as "vertical", "horizontal", "up", "down", "bottom", "top", "side", "front", "rear", "left", "right", "forward", "rearward", and the like, are used only as relative conventions and not as absolute orientations with respect to a fixed coordinate system, such as the acting direction of gravity. Additionally, where the term "substantially" or "approximately" is employed with respect to a given measurement, value or characteristic, it refers to a quantity that is within a normal operating range to achieve desired results, but that includes some variability due to inherent inaccuracy and error within the allowed tolerances (e.g. 1-2%) of the system. Accordingly, this description is meant to be taken only by way of example, and not to otherwise limit the scope of this invention.

What is claimed is:

1. A fluid dispenser comprising:
a dispenser bulb comprising:
an inner reservoir;
an opening at a top of the bulb for fluid to drain into the bulb from a bottle of the fluid, the fluid draining into the bulb under the force of gravity; and
a dispenser pore, wherein the dispenser pore remains closed in a relaxed conformation, and wherein the dispenser pore is adapted to open and release a fluid stored in the inner reservoir when the bulb is squeezed by a user;
a bottle holder configured to hold the bottle with a mouth of the bottle facing downwards into the dispenser bulb; and
at least one suction cup mount adapted to engage with a suction cup, wherein the suction cup mount comprises side rails that define a notch, and a holding area adapted to hold a nub of a suction cup.

2. The fluid dispenser of claim 1, wherein the dispenser bulb is made of silicone.

3. The fluid dispenser of claim 1, wherein the dispenser pore is a slit cut in the dispenser bulb.

4. The fluid dispenser of claim 1, further comprising at least one hook on an exterior surface of the bottle holder, the hook being unitary with the bottle holder.

5. The fluid dispenser of claim 1, wherein the bottle holder further comprises an air-release mechanism on an inner surface of the bottle holder, the air release mechanism selected from the group consisting of vertical ribs, bumps, and horizontal ribs.

6. The fluid dispenser of claim 1, wherein the bottle holder has at least one air-release hole through a wall of the bottle holder.

7. The fluid dispenser of claim 1, wherein the at least one suction cup mount is thicker at the bottom and thinner at the top, so that the fluid dispenser is held farther away from a mounting surface at the bottom of the suction cup mount.

8. The fluid dispenser of claim 1, further comprising a stand-off extension extending outwards from the bottle holder below the suction cup mount.

9. The fluid dispenser of claim 1, wherein a width of the dispenser bulb is greater than a depth of the dispenser bulb.

10. The fluid dispenser of claim 1, wherein the bottle holder is configured to be removably sealed to the bottle.

11. The dispenser of claim 1, wherein the fluid dispenser provides support for the bottle to hold the bottle of the fluid with the opening of the bottle of the fluid in a downward orientation, so that fluid drains from the bottle into the bulb under the force of gravity.

12. The dispenser of claim 11, wherein the suction cup mount is at a rear of the fluid dispenser, and wherein the suction cup mount is located above the center of gravity of the fluid dispenser so that the suction cup mount holds the fluid dispenser in a position with the bottle in a downward orientation so that the fluid drains from the bottle into the bulb under the force of gravity.

13. A fluid dispenser comprising:

a dispenser bulb comprising:

an inner reservoir;

an opening at a top of the bulb for fluid to drain into the bulb from a bottle of the fluid, the fluid draining into the bulb under the force of gravity; and a dispenser pore, wherein the dispenser pore remains closed in a relaxed conformation, and wherein the dispenser pore is adapted to open and release a fluid stored in the inner reservoir when the bulb is squeezed by a user;

a bottle holder configured to hold the bottle with a mouth of the bottle facing downwards into the dispenser bulb; and wherein the bottle holder further comprises a silicone rubber sleeve that defines a bottle pocket adapted for holding the bottle within the bottle pocket and with the mouth of the bottle facing downwards into the dispenser bulb, and wherein the fluid dispenser further comprises a suction cup mount at a rear of the fluid dispenser, the suction cup mount adapted to engage with a suction cup, the suction cup mount located above the center of gravity of the fluid dispenser so that the suction cup mount holds the fluid dispenser in a position with the bottle in a downward orientation so that the fluid drains from the bottle into the bulb under the force of gravity.

14. The dispenser of claim 3, wherein the slit is oriented from the rear of the bulb to the front of the bulb, wherein the dispenser pore is oriented parallel to an imaginary line from the suction cup mount at the rear of the fluid dispenser to the front of the fluid dispenser.

15. The fluid dispenser of claim 1, wherein the bottle holder further comprises a silicone rubber sleeve that defines a bottle pocket adapted for holding the bottle within the bottle pocket and with the mouth of the bottle facing downwards into the dispenser bulb, and wherein the suction cup mount is located above the center of gravity of the fluid dispenser so that the suction cup mount holds the fluid dispenser in a position with the bottle in a downward orientation so that the fluid drains from the bottle into the bulb under the force of gravity.

16. A fluid dispenser comprising:

a dispenser bulb comprising:

an inner reservoir;

an opening at a top of the bulb for fluid to drain into the bulb from a bottle of the fluid, the fluid draining into the bulb under the force of gravity; and a dispenser pore, wherein the dispenser pore remains closed in a relaxed conformation, and wherein the dispenser pore is adapted to open and release a fluid stored in the inner reservoir when the bulb is squeezed by a user;

a bottle holder configured to hold the bottle with a mouth of the bottle facing downwards into the dispenser bulb; and at least one hook on an exterior surface of the bottle holder, the hook being unitary with the bottle holder.

17. A fluid dispenser comprising:

a dispenser bulb comprising:

an inner reservoir;

an opening at a top of the bulb for fluid to drain into the bulb from a bottle of the fluid, the fluid draining into the bulb under the force of gravity; and a dispenser pore, wherein the dispenser pore remains closed in a relaxed conformation, and wherein the dispenser pore is adapted to open and release a fluid stored in the inner reservoir when the bulb is squeezed by a user;

a bottle holder configured to hold the bottle with a mouth of the bottle facing downwards into the dispenser bulb, wherein the bottle holder has at least one air-release hole through a wall of the bottle holder.

* * * * *